US005894824A

United States Patent [19]

Watanabe et al.

[11] Patent Number: 5,894,824

[45] Date of Patent: Apr. 20, 1999

[54] PISTON FOR INTERNAL COMBUSTION ENGINES

[75] Inventors: Hiroaki Watanabe, Kanagawa; Kazuhiko Shirane, Yokohama; Shingo Motoda; Hideyuki Miyasaka, both of Kanagawa, all of Japan

[73] Assignee: Unisia Jecs Corporation, Atsugi, Japan

[21] Appl. No.: 08/808,749

[22] Filed: Feb. 28, 1997

[30] Foreign Application Priority Data

| | | | |
|---|---|---|---|
| Feb. 29, 1996 | [JP] | Japan | 8-069410 |
| Oct. 18, 1996 | [JP] | Japan | 8-295872 |
| Oct. 23, 1996 | [JP] | Japan | 8-297916 |
| Oct. 31, 1996 | [JP] | Japan | 8-304198 |
| Nov. 11, 1996 | [JP] | Japan | 8-312630 |
| Nov. 29, 1996 | [JP] | Japan | 8-333033 |
| Feb. 18, 1997 | [JP] | Japan | 9-048558 |

[51] Int. Cl.[6] ..... F02F 3/00

[52] U.S. Cl. ..... 123/193.6

[58] Field of Search ..... 123/193.6; 92/187

[56] References Cited

U.S. PATENT DOCUMENTS

| | | | |
|---|---|---|---|
| 3,626,815 | 12/1971 | Fingeroot et al. | 123/193.6 |
| 4,468,309 | 3/1987 | Schellmann . | |
| 5,054,375 | 10/1991 | Kawabata et al. | 123/193.6 |
| 5,063,893 | 11/1991 | Iwaya | 123/193.6 |
| 5,113,817 | 5/1992 | Kemnitz et al. | 123/193.6 |
| 5,331,932 | 7/1994 | Watanabe et al. | 123/193.6 |

FOREIGN PATENT DOCUMENTS

| | | |
|---|---|---|
| 55-9871 | 1/1980 | Japan . |
| 63-92867 | 6/1988 | Japan . |
| 1-71157 | 5/1989 | Japan . |

*Primary Examiner*—Marguerite McMahon
*Attorney, Agent, or Firm*—Foley & Lardner

[57] ABSTRACT

A piston for an internal combustion engine includes a ring land formed with a piston-ring groove, and a skirt connected to the ring land so that the piston-ring groove is adjacent thereto, the skirt being formed with a piston-pin hole with an axis, and having a plane including the axis of the piston-pin hole. A taper is formed on the skirt in a first portion thereof nearer to the ring land than the plane to converge on the ring land.

10 Claims, 19 Drawing Sheets

PISTON FOR INTERNAL COMBUSTION ENGINES

BACKGROUND OF THE INVENTION

The present invention relates to a piston for internal combustion engines.

A conventional piston for internal combustion engines is disclosed, for example, in Japanese Utility Model Application No. 55-9871. This piston comprises a ring land and a skirt connected thereto. The ring land is formed with ring grooves. The skirt is formed with a piston-pin hole with a center line which is offset to the counterthrust side of the piston with respect to a center line thereof. Struts having different weights are cast in the skirt in the inner wall on the thrust and counterthrust sides of the piston. The struts serve to restrain thermal expansion of an upper end portion of the skirt during engine operation, and to position a center of gravity of the piston nearly just above the center of the piston-pin hole.

The piston is arranged in a cylinder. A connecting rod is connected to the piston by a piston pin arranged through the piston-pin hole. During engine operation, the piston undergoes, before the top dead center of a compression stroke, a force in the counterthrust direction due to a pressing force out of the connecting rod inclined and a pressure of compressed gas, sliding on a counterthrust-side inner peripheral surface of the cylinder. When approaching the top dead center, the piston undergoes not only reduced force in the counterthrust direction since the inclination of the connection rod is decreased, but a counterclockwise moment since the piston-pin hole is offset to the counterthrust side of the piston.

As a result, the piston has a thrust-side upper end contacting a thrust-side inner peripheral surface of the cylinder, and a counterthrust-side lower end contacting the counterthrust-side inner peripheral surface of the cylinder. After this, the piston proceeds to an expansion stroke to undergo a force in the thrust direction due to a pressure of combustion gas and a reaction force out of the connecting rod. With increasing force in the thrust direction, the piston is moved downward with a portion between the thrust-side upper end and a lower end being widely in slide contact with the thrust-side inner peripheral surface of the cylinder.

In such a way, due to the piston-pin hole offset to the counterthrust side of the piston, the piston undergoes the counterclockwise moment in the expansion stroke. This moment operates to enlarge a clearance between an end of the skirt in the slide direction and the inner peripheral surface of the cylinder, enabling supply of lubricating oil to all thrust-side side surface of the piston.

However, the effect of restraining thermal expansion of the upper end portion of the skirt by the struts has a limit, and existence of the struts prevents the upper end portion of the skirt from being deformed, so that the skirt has in the vertical direction a great variation in the deformability which originates substantially from the vicinity of the oil ring groove. As a result, in order to prevent seizure, a thrust-side upper end of the skirt which contacts the inner peripheral surface of the cylinder in the expansion stroke needs to provide a taper with greater inclination in an upper portion of the piston.

This taper causes greater oscillating motion of the piston in the low-speed expansion stroke when the thrust-side upper end of the skirt contacts the inner peripheral surface of the cylinder. That is, the piston has kinetic energy increased when coming in slide contact with the inner peripheral surface of the cylinder, vibrating the cylinder to produce great hammering. Moreover, enlargement of the clearance between the upper end of the skirt and the inner peripheral surface of the cylinder results in small pressure acting area of the skirt. This increases a surface pressure on a thrust-side portion of the skirt, producing difficult formation of an oil film on a thrust-side peripheral surface of the skirt, resulting in possible increase in the friction thereat.

It is, therefore, an object of the present invention to provide a piston for internal combustion engines which has less hammering of the piston, and reduced friction between the piston and the cylinder in the expansion stroke.

SUMMARY OF THE INVENTION

According to one aspect of the present invention, there is provided a piston for an internal combustion engine, the piston being operative on thrust and counterthrust sides, comprising:

a ring land formed with a piston-ring groove;

a skirt connected to said ring land so that said piston-ring groove is adjacent thereto, said skirt being formed with a piston-pin hole with an axis, said skirt having a plane including said axis of said piston-pin hole; and a taper formed on said skirt in a first portion thereof nearer to said ring land than said plane, said taper converging on said ring land.

Another aspect of the present invention lies in providing a piston for an internal combustion engine, the piston being operative on thrust and counterthrust sides, comprising:

a ring land formed with a piston-ring groove;

a skirt connected to said ring land so that said piston-ring groove is adjacent thereto, said skirt being formed with a piston-pin hole with an axis, said skirt having a plane including said axis of said piston-pin hole; and means for forming a taper on said skirt in a first portion thereof nearer to said ring land than said plane, said taper forming means converging on said ring land.

DETAILED DESCRIPTION OF THE INVENTION

Figure 1:
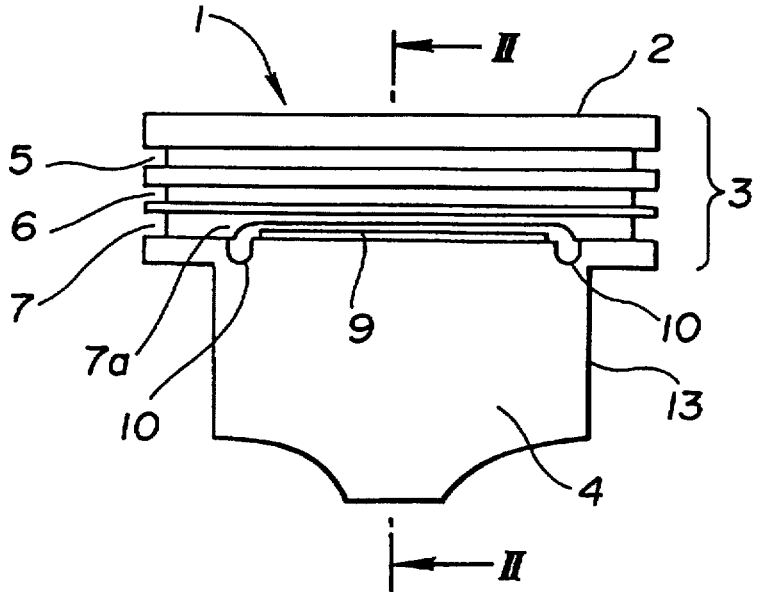
FIG. 1 is a front view showing a first preferred embodiment of a piston for internal combustion engines according to the present invention.

Referring to the drawings, a description will be made with regard to preferred embodiments of a piston for internal combustion engines.

Figure 2:
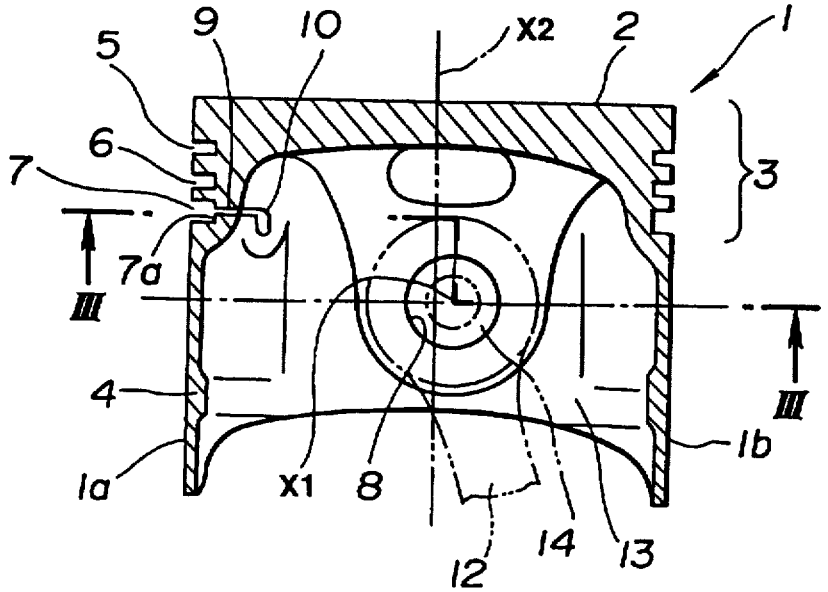
FIG. 2 is a sectional view taken along the line II—II in FIG. 1.
Figure 3:
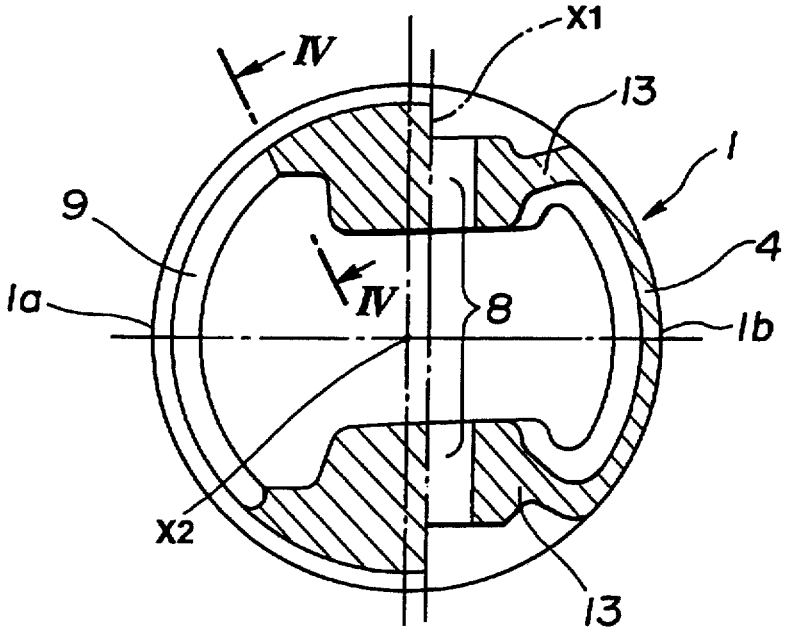
FIG. 3 is a view similar to FIG. 2, taken along the line III—III in FIG. 2.

FIGS. 1–5 show a first embodiment of the present invention. Referring to FIGS. 1–3, a piston 1 includes a crown face 2, and a ring land 3 formed around the crown face 2, and an apron 13 and skirt 4 connected to the ring land 3.

Figure 4:
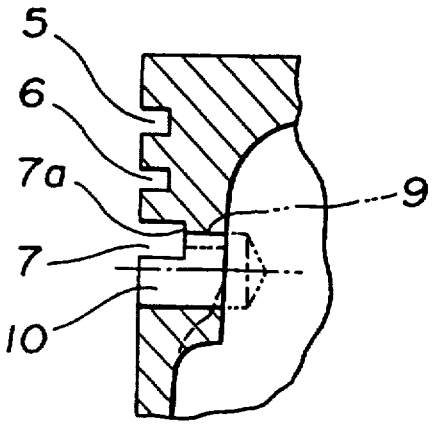
FIG. 4 is a view similar to FIG. 3, taken along the line IV—IV in FIG. 3.

The ring land 3 is formed with piston-ring grooves 5, 6, 7. As best seen in FIG. 4, on a thrust side 1*a* of the piston 1, a slit 9 is formed through a bottom 7*a* of the piston-ring groove 7 disposed the nearest to the skirt 4 to ensure communication between the inside and outside of the piston. Moreover, a recess hole 10 is formed at either circumferential end of the slit 9.

The apron 13 is formed with a piston-pin hole 8 extending substantially in the direction of the diameter of the piston 1. A center line X1 of the piston-pin hole 8 is offset to a counterthrust side 1*b* of the piston 1 with respect to a center line X2 of the piston 1.

The skirt 4 is continuously connected to the apron 13, and is formed on both sides of the piston 1 substantially parallel to the piston-pin hole 8. In the first embodiment, the skirt 4 is partly eliminated on both sides of the piston-pin hole 8 as shown in FIG. 3.

Figure 5:
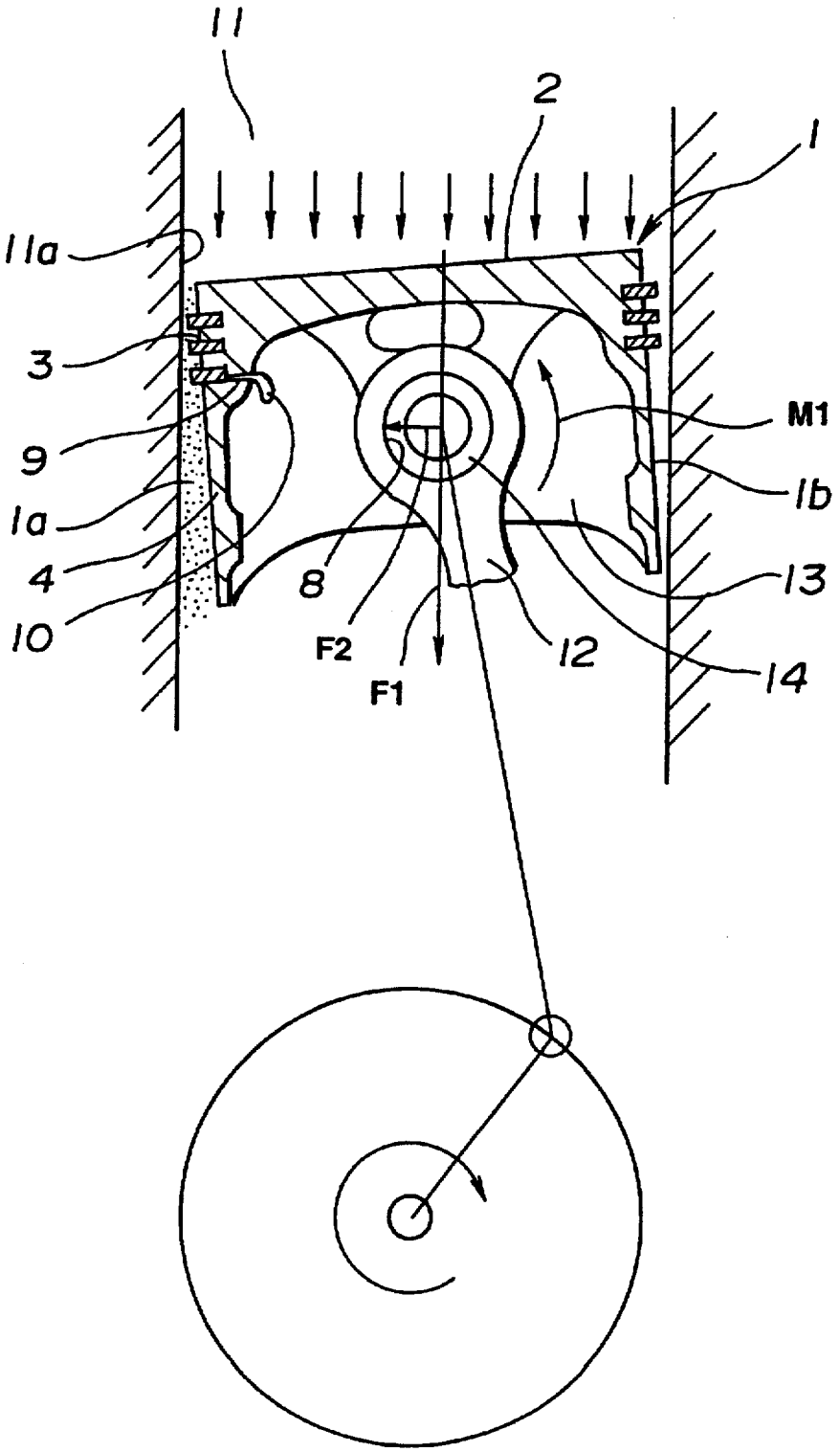
FIG. 5 is a view similar to FIG. 4, showing the piston in the expansion stroke.

Referring to FIG. 5, the piston 1 is arranged in a cylinder 11. A connecting rod 12 is connected to the piston 1 by a piston pin 14 arranged through the piston-pin hole 8.

Next, the behavior of the piston 1 in an expansion stroke will be described. In the expansion stroke as shown in FIG. 5, the crown face 2 of the piston 1 undergoes a pressure F1 of combustion gas, so that the piston 1 is pressed to a lower portion of the cylinder 11. With this, due to a reaction force out of the connecting rod 12 inclined, the piston 1 undergoes a force F2 in the thrust direction. Simultaneously, due to the piston-pin hole 8 offset to a counterthrust side 1*b*, the piston 1 undergoes a counterclockwise moment M1 about the piston-pin hole 8. This enlarges a clearance between a lower end of the skirt 4 on the thrust side 1*a*, i.e. an end of the skirt 4 on the thrust side 1*a* in the slide direction, and an inner peripheral surface 11*a* of the cylinder 11, enabling supply of lubricating oil out of a crank case to all side surface of the piston 1 on the thrust side 1*a*.

With downward movement, the side surface of the piston 1 on the thrust side 1*a* comes in slide contact with the inner peripheral surface 11*a* of the cylinder 11. The piston 1 is constructed such that, on the thrust side 1*a*, the slit 9 is formed between the ring land 3 with high rigidity and the skirt 4, and the recess hole 10 is formed at either end of the slit 9, decreasing the rigidity of an upper end of the skirt 4, resulting in possible reduction in a taper thereof. Thus, an area of the skirt 4 on the thrust side 1*a* contacting the inner peripheral surface 11*a* of the cylinder 11 is expanded in the axial direction of the piston 1, enabling restrained oscillating motion of the piston 1 when the skirt 4 on the thrust side 1*a* contacts the inner peripheral surface 11*a* of the cylinder 11.

Moreover, due to decreased taper of the upper end of the skirt 4, when coming in slide contact with the inner peripheral surface 11*a* of the cylinder 11, the skirt 4 on the thrust side 1*a* receives a pressure by a wide area, resulting in possible reduction in a surface pressure on the skirt 4 on the thrust side 1*a*.

Therefore, according to the first embodiment, occurrence of hammering of the piston 1 can be restrained during low-speed operation, and the friction between the side surface of the piston 1 on the thrust side 1*a* and the inner peripheral surface 11*a* of the cylinder 11 can be reduced by the thickness of a lubricating-oil film secured on the side surface of the piston 1.

Figure 6:
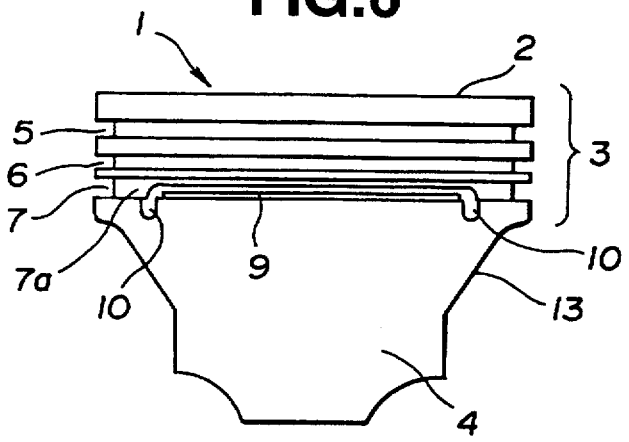
FIG. 6 is a view similar to FIG. 1, showing a second preferred embodiment of the present invention.

FIG. 6 shows a second embodiment of the present invention. The second embodiment is substantially the same as the first embodiment except that the circumferential dimension of the skirt 4 is greater in a portion near the ring land 3 than in a portion near the lower end of the piston 1.

According to the second embodiment, in addition to achievement of the same effect as that of the first embodiment, a reduction in a surface pressure on the upper end of the skirt 4 can be obtained due to enlargement of a pressure acting area thereof. This feature is more favorable for securing of the thickness of a lubricating-oil film on the side surface of the piston on the thrust side 1*a*.

Figure 7:
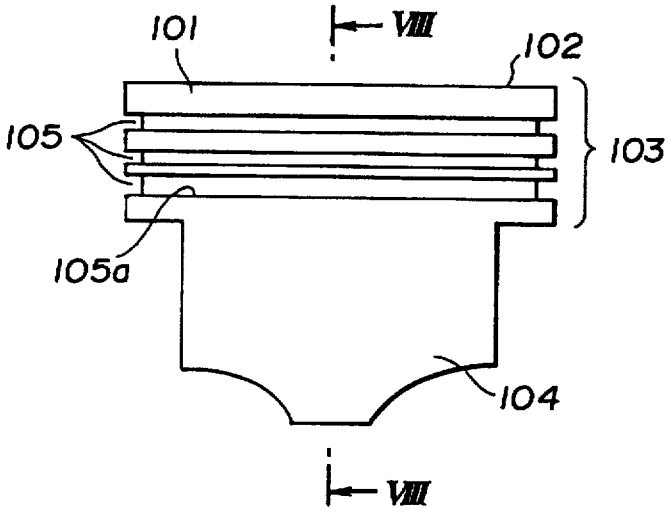
FIG. 7 is a view similar to FIG. 6, showing a third preferred embodiment of the present invention.
Figure 8:
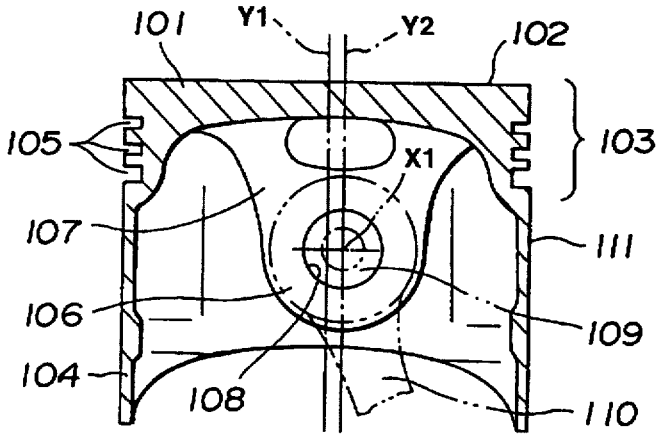
FIG. 8 is a view similar to FIG. 5, taken along the line VIII—VIII in FIG. 7.
Figure 9:
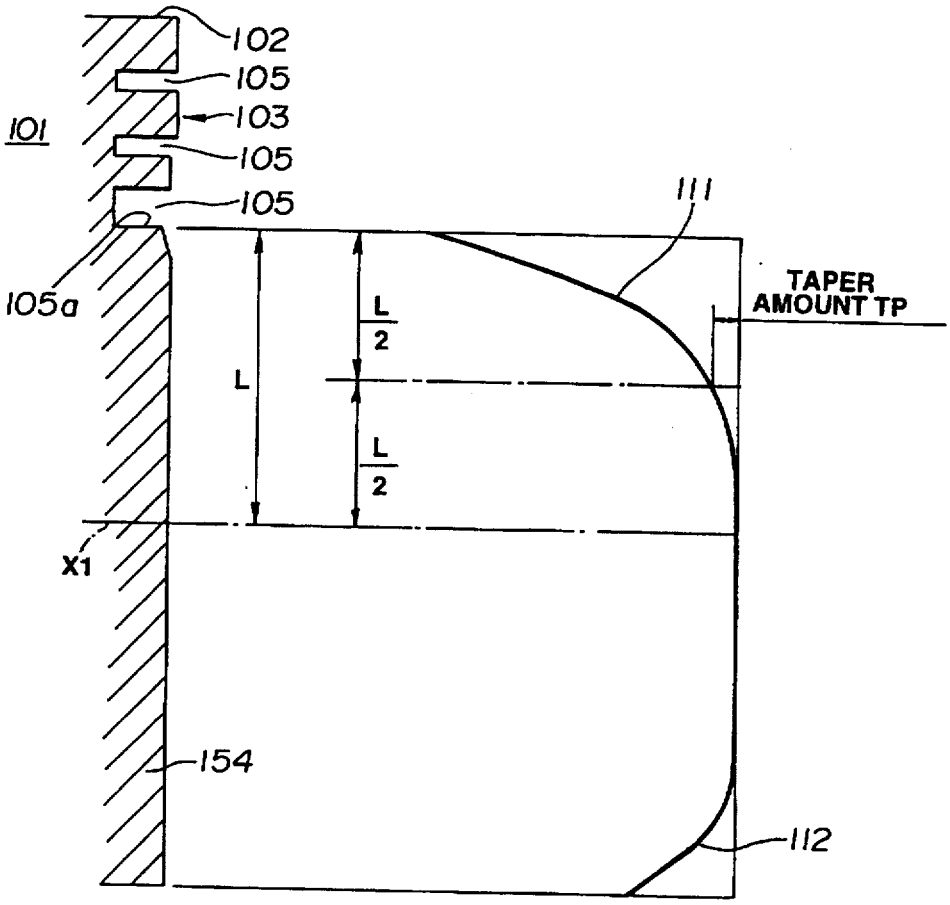
FIG. 9 is an enlarged diagrammatic view showing the shape of a taper formed at a skirt.

FIGS. 7–10C show a third embodiment of the present invention. Referring to FIGS. 7–8, a piston 101 includes a crown face 102, and a ring land 103 connected to the crown face 102, and a skirt 104 connected to the ring land 103. In the third embodiment, the ring land 103 is formed with three piston-ring grooves 105.

Pin bosses 106 are formed at the skirt 104 at the inner periphery, each being connected thereto through an apron 107. The pin bosses 106 are disposed to face each other with respect to an axis Y1 of the piston 101. The pin boss 106 is formed with a piston-pin hole 108 facing the skirt 104 and having an axis X1 which is substantially perpendicular to the axis Y1 of the piston 101. The axis X1 of the piston-pin hole 108 is offset to the counterthrust side of the piston 101 with respect to the axis Y1 thereof as shown in FIG. 8. Referring to FIG. 8, Y2 is a line which intersects the axis X1 of the piston-pin hole 108 and is parallel to the axis Y1 of the piston 101.

A piston pin 109 is arranged through the piston-pin hole 108, and a connecting rod 110 is connected thereto.

A taper 111 is formed at the skirt 104 of the piston 101. Specifically, the taper 111 is formed at the skirt 104 in a portion nearer to the ring land 103 than a plane including the axis X1 of the piston-pin hole 108, i.e. a portion above the axis X1. The taper 111 has a shape to converge on the ring land 103. Specifically, referring to FIG. 9, the taper 111 has a taper amount TP increased to the ring land 103 in a quadratic-curve way.

It is noted that the taper 111 can be formed at least at the skirt 104 on the thrust side of the piston 101 when taking account of the behavior of the piston 101 as will be described later.

Excellent results were given when, at a position of half of a dimension L from the axis X1 of the piston-pin hole 108 to a side surface 105*a* of the piston ring groove 105 disposed the nearest to the skirt 104, the taper amount TP of the taper 111 is determined to a value obtained by multiplying the diameter (μm) of the piston 101 by 0.00015 to 0.00025.

In the third embodiment, a taper 112 is formed at an end of the skirt 104 far from the ring land 103, i.e. a lower end thereof, to converge on this end.

Figure 10A:
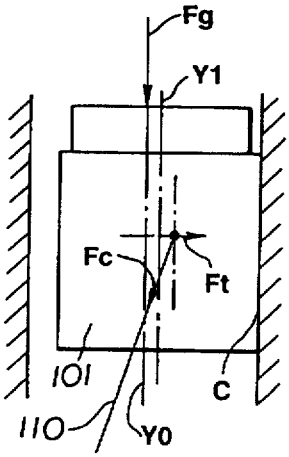
FIG. 10A is a diagrammatic view showing a piston before the top dead center of a compression stroke.
Figure 10B:
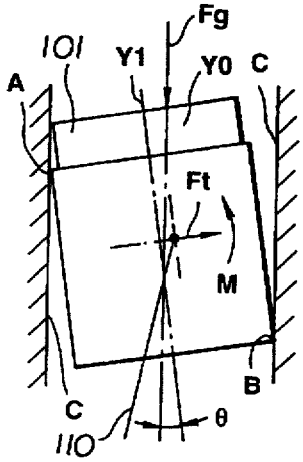
FIG. 10B is a view similar to FIG. 10A, showing the piston just before the top dead center of the compression stroke.
Figure 10C:
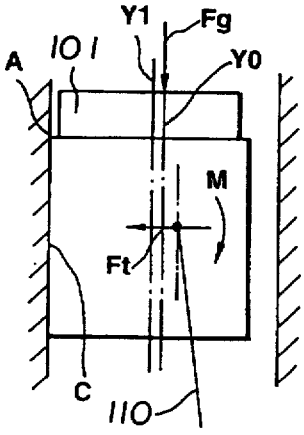
FIG. 10C is a view similar to FIG. 10B, showing the piston after the top dead center of the compression stroke.

The piston 101 is arranged in an engine, not shown, for operation. During operation of the engine, the piston 101 shows the behavior as shown in FIGS. 10A–10C in compression and expansion strokes. Specifically, referring to FIG. 10A, before the top dead center of the compression stroke, the piston 101 undergoes a pressure Fg of compressed gas (to be exact, the sum of the pressure of compressed gas and an inertia force of the piston 101). The compressed-gas pressure Fg is split into a force Fc for the connecting rod 110 inclined and a thrust force Ft, so that the piston 101 undergoes the thrust force Ft to move on an inner surface C of a cylinder on the counterthurst side.

When the piston 101 approaches the top dead center, the thrust force Ft is reduced with increasing compressed-gas pressure Fg and decreasing inclination of the connecting rod 110. As a result, referring to FIG. 10B, the piston 101 produces a moment M to rotate counterclockwise on a lower end B of the skirt, having an upper end A of the skirt on the thrust side of the piston 101 contacting the inner surface C of the cylinder on the thrust side thereof. In this state, the piston 101 enters the expansion stroke.

Referring to FIG. 10C, when the piston 101 passes the top dead center, the inclination of the connecting rod 110 is reversed. This changes the direction of the thrust force Ft, so that the piston 101 produces a moment M to rotate clockwise on the upper end A of the skirt, having a side surface of the skirt on the thrust side of the piston 101 contacting the inner surface C of cylinder on the thrust side thereof. After this, the piston 101 enters the expansion stroke to move on the inner surface C of the cylinder on the thrust side of the piston 101.

In the vicinity of the top dead center of the compression stroke, the upper end A of the skirt is inclined by contacting the inner surface C of the cylinder. According to the third embodiment, since the taper 111 is formed at the skirt 104 in the portion nearer the ring land 103 than the plane including the axis X1 of the piston-pin hole 108, an inclination 6 of the axis Y1 of the piston 101 with respect to an axis Y0 of the cylinder is smaller than that of the conventional piston.

Therefore, in the expansion stroke just after explosion, when rotating clockwise on the upper end A of the skirt to have the side surface contacting the inner surface C of the cylinder, the piston 101 ensures rotation with reduced angle. This results in less kinetic energy of the piston 101, and thus less occurrence of hammering. Therefore, the piston 101 can be obtained with piston slap maximally reduced.

Figure 11:
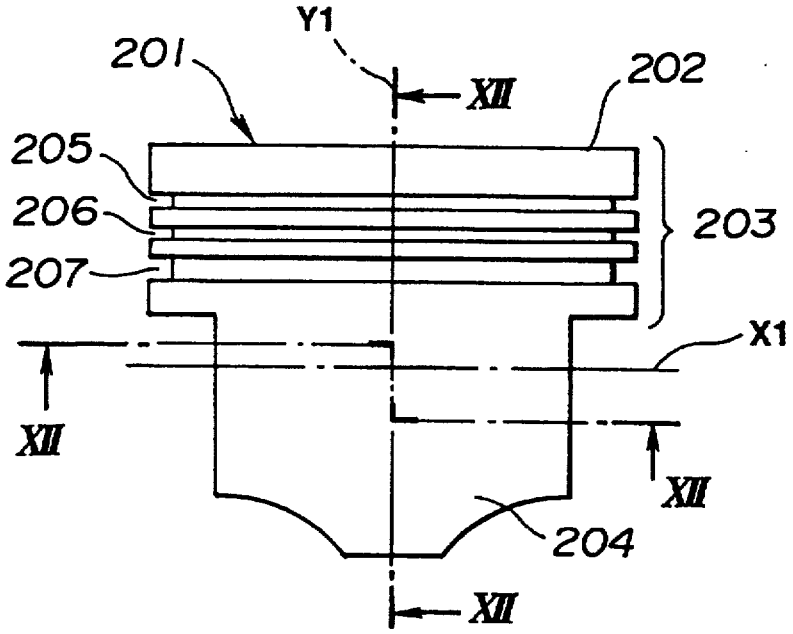
FIG. 11 is a view similar to FIG. 7, showing a fourth preferred embodiment of the present invention.
Figure 12:
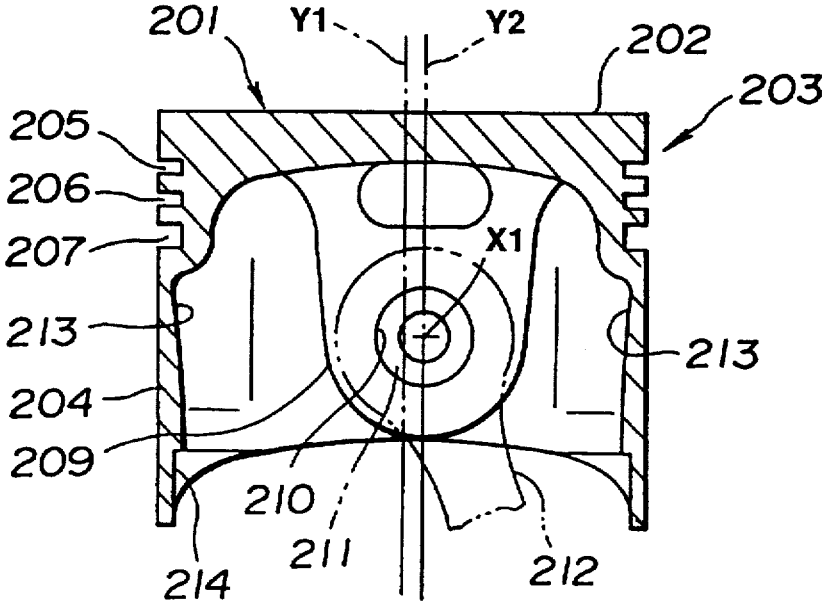
FIG. 12 is a view similar to FIG. 8, taken along the line XII—XII in FIG. 11.
Figure 13:
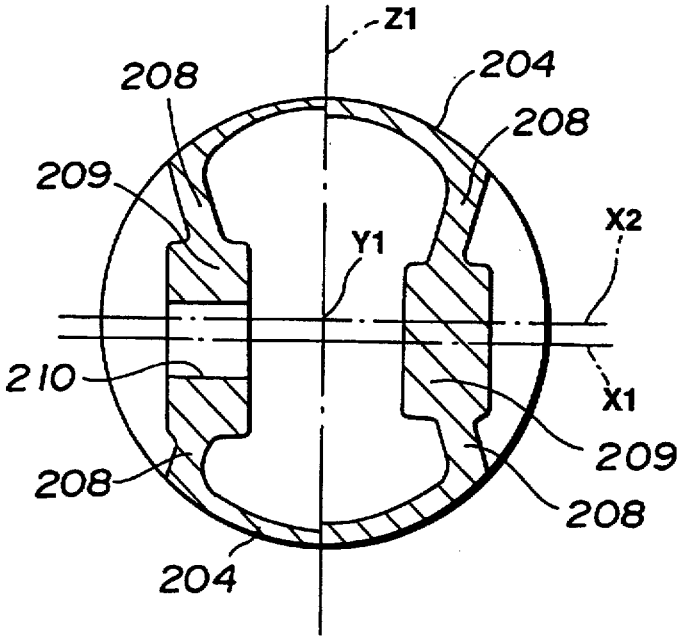
FIG. 13 is a view similar to FIG. 12, taken along the line XIII—XIII in FIG. 11.

FIGS. 11–14C show a fourth embodiment of the present invention. Referring to FIGS. 11–13, a piston 201 includes a crown face 202, a ring land 203 connected to the crown face 202, and a skirt 204 connected to the ring land 203. In the fourth embodiment, the ring land 203 is formed with three piston-ring grooves 205, 206, 207. The piston-ring grooves 205, 206 formed near the crown face 202 serve as compression-ring grooves, and the piston-ring groove 207 formed adjacent to the skirt 204 serves as an oilring groove.

Aprons 208 are formed at the skirt 204, and pin bosses 209 are formed to protrude from the aprons 208 to the inner periphery of the skirt 204. As shown in FIG. 13, the aprons 208 and pin bosses 209 are arranged to face each other with respect to an axis Y1 of the piston 201. The pin boss 209 is formed with a piston-pin hole 210 having both ends open at the apron 208. The piston-pin hole 210 has an axis X1 which is substantially perpendicular to the axis Y1 of the piston 201, and is offset to the counterthrust side of the piston 201 with respect to the axis Y1 thereof as shown in FIG. 12. Referring to FIG. 12, Y2 is a line which intersects the axis X1 of the piston-pin hole 210 and is parallel to the axis Y1 of the piston 201.

A piston pin 211 is arranged through the piston-pin hole 210, and a connecting rod 212 is connected thereto.

A taper 213 is formed at the skirt 204 of the piston 201 on the inner periphery at least on the thrust side of the piston 201 so as to gradually increase the thickness of the skirt 204 from a portion nearer to the ring land 203 than a plane including the axis X1 of the piston-pin hole 210 to a portion far therefrom. Specifically, in the fourth embodiment, referring to FIG. 12, the tapers 213 are formed at the skirt 204 on the inner periphery on both thrust and counterthrust sides of the piston 201 so as to obtain axial change in the thickness of the skirt 204 in such a way that the thickness is small at the upper end and great at the lower end.

As shown in FIG. 13, except to largely vary for smooth connection with the apron 208, the thickness of the skirt 204 is substantially the same or gradually increased to the apron 208 with respect to the circumferential direction. Referring to FIG. 13, X2 is a line which intersects the axis Y1 of the piston 210 and is parallel to the axis X1 of the piston-pin hole 210, and Z1 is a line which intersects the axis Y1 of the piston 201 and is perpendicular to the line X2.

Referring to FIG. 12, a step 214 is formed at the lowermost position of the skirt 204 at the inner periphery to serve as a reference for machining the piston 201.

Figures 14A, 14B, 14C:
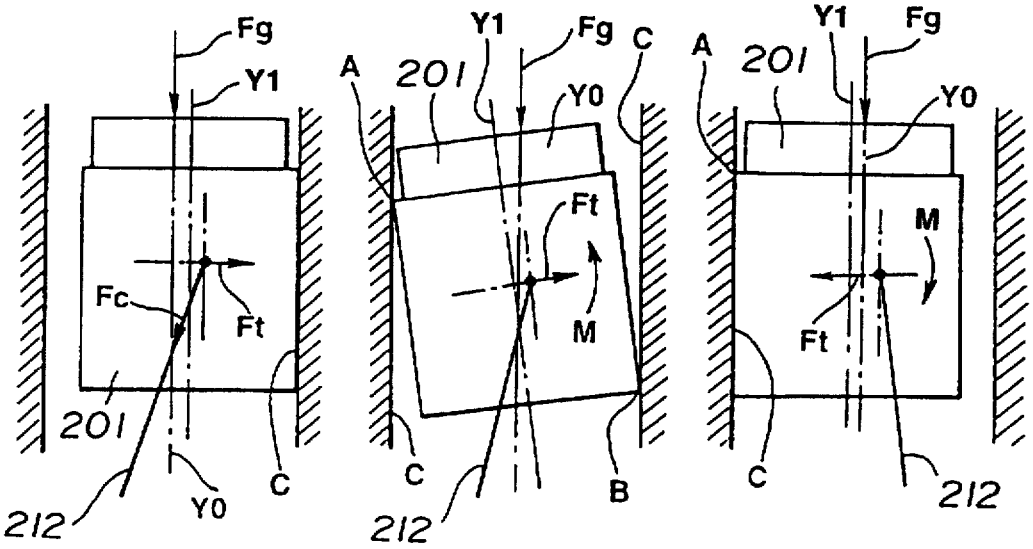
FIG. 14A is a view similar to FIG. 10C, showing a piston before the top dead center of the compression stroke.
FIG. 14B is a view similar to FIG. 14A, showing the piston just before the top dead center of the compression stroke.
FIG. 14C is a view similar to FIG. 14B, showing the piston after the top dead center of the compression stroke.

The piston 201 is arranged in an engine, not shown, for operation. During operation of the engine, the piston 201 shows the behavior as shown in FIGS. 14A–14C in compression and expansion strokes. Referring to FIGS. 14A–14C, Y0 is an axis of a cylinder. Referring to FIG. 14A, before the top dead center of the compression stroke, the piston 201 undergoes a pressure Fg of compressed gas (to be exact, the sum of the pressure of compressed gas and an inertia force of the piston 201). The compressed-gas pressure Fg is split into a force Fc for the connecting rod 212 inclined and a thrust force Ft, so that the piston 201 undergoes the thrust force Ft to move on an inner surface C of the cylinder on the counterthurst side.

When the piston 201 approaches the top dead center, the thrust force Ft is reduced with increasing compressed-gas pressure Fg and decreasing inclination of the connecting rod 212. As a result, referring to FIG. 14B, the piston 201 produces a moment M to rotate counterclockwise on a lower end B of the skirt, having an upper end A of the skirt on the thrust side of the piston 201 contacting the inner surface C of the cylinder on the thrust side thereof. In this state, the piston 201 enters the expansion stroke.

Referring to FIG. 14C, when the piston 201 passes the top dead center, the inclination of the connecting rod 212 is reversed. This changes the direction of the thrust force Ft, so that the piston 201 produces a moment M to rotate clockwise on the upper end A of the skirt, having a side surface of the skirt on the thrust side of the piston 201 contacting the inner surface C of cylinder on the thrust side thereof. After this, the piston 201 enters the expansion stroke to move on the inner surface C of the cylinder on the thrust side of the piston 201.

Just after the top dead center, the piston 201 undergoes on the side surface on the thrust side thereof the greatest side force due to the thrust force Ft. Studies revealed that the center of a piston area which undergoes a surface pressure greater than a predetermined value is positioned above the axis X1 of the piston-pin hole 210, and a piston area which undergoes the greatest surface pressure is also positioned thereabove.

According to the fourth embodiment, the thickness of the skirt 204 is decreased in the area which undergoes relatively great side force, i.e. in the portion nearer to the ring land 203 than the plane including the axis X1 of the piston-pin hole 210, obtaining decreased rigidity thereof in the above area. This reduces an impact force produced when the piston 201 contacts the inner surface C of the cylinder, and effectively restrains an increase in a surface pressure on the skirt 204.

Moreover, the thickness of the skirt 204 is gradually increased from the thin portion near the ring land 203, making a border between the thick and thin portions indistinct, resulting in no local increase in a surface pressure on the skirt 204 at the border. This prevents the friction between the piston 201 and the inner surface of the cylinder from increasing. Therefore, the piston 201 can be obtained with piston slap maximally reduced and friction lowered.

Figure 15:
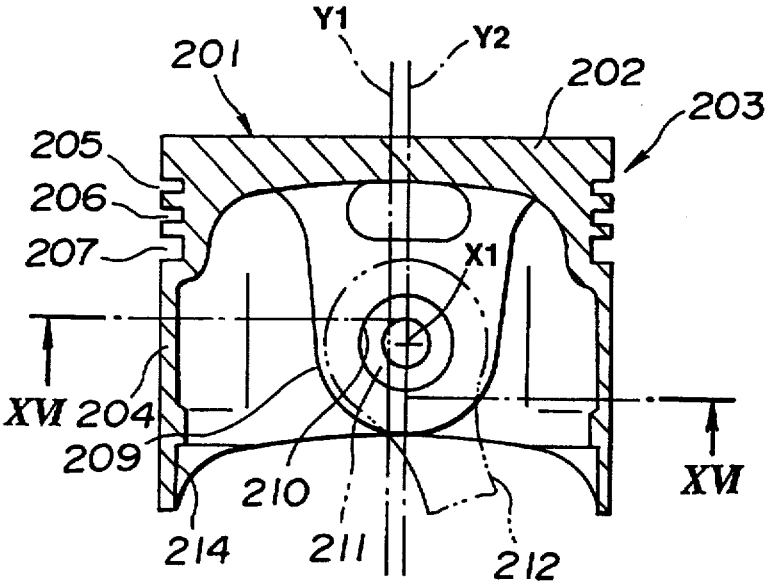
FIG. 15 is a view similar to FIG. 12, showing a fifth preferred embodiment of the present invention.
Figure 16:
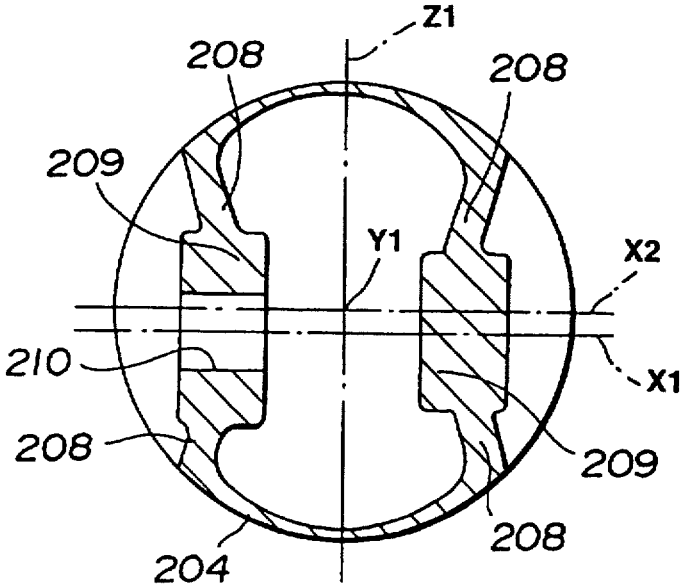
FIG. 16 is a view similar to FIG. 15, taken along the-line XVI—XVI in FIG. 15.

FIGS. 15–16 show a fifth embodiment of the present invention. The fifth embodiment is substantially the same as the fourth embodiment except that the thickness of the skirt 204 on the thrust side of the piston 201 is gradually circumferentially increased from a position substantially perpendicular to the axis X1 of the piston-pin hole 210, and it is gradually increased from a portion nearer to the ring land 203 than a plane including the axis X1 of the piston-pin hole 210 to a portion far therefrom except a position substantially perpendicular to the axis X1.

Specifically, in the fifth embodiment, referring to FIG. 16, the thicknesses of the skirt 204 on both thrust and counterthrust sides of the piston 201 are the smallest at positions substantially perpendicular to the axis X1 of the piston-pin hole 210, and they are gradually circumferentially increased from the above positions. Moreover, each thickness of the skirt 204 is gradually increased from the portion nearer to the ring land 203 than the plane including the axis X1 of the piston-pin hole 210 to the portion far therefrom except the position substantially perpendicular to the axis X1. That is, at the position substantially perpendicular to the axis X1 of the piston-pin hole 210, the thickness of the skirt 204 is axially substantially the same, whereas at the other positions, it is gradually increased from the portion nearer to the ring land 203 than the plane including the axis X1 of the piston-pin hole 210 to the portion far therefrom.

According to the fifth embodiment, the thickness of the piston 201 on the thrust side thereof is gradually circumferentially increased from the position substantially perpendicular to the axis X1 of the piston-pin hole 210, and it is decreased in the portion nearer to the ring land 203 than the plane including the axis X1 of the piston-pin hole 210, obtaining the same effect as that of the fourth embodiment.

It is noted that, in place of being offset to the counterthrust side of the piston 201 with respect to the axis Y1 thereof, the axis X1 of the piston-pin hole 210 may be offset to the thrust side of the piston 201.

Figure 17:
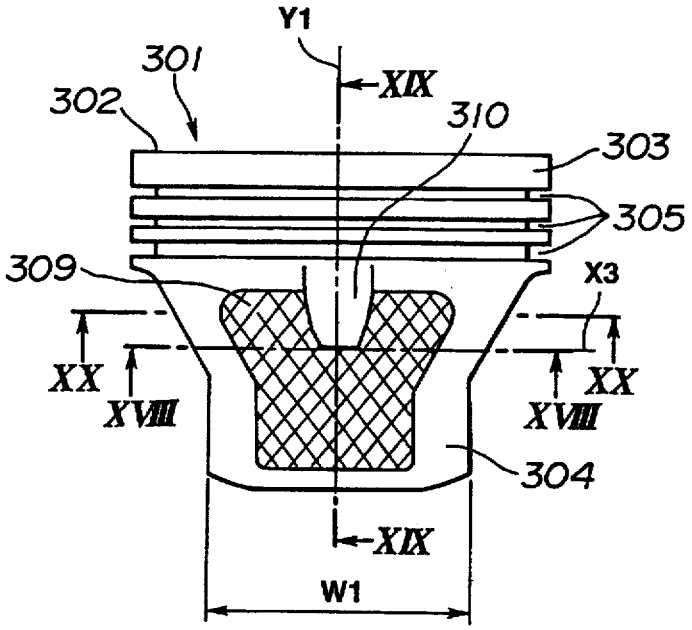
FIG. 17 is a view similar to FIG. 11, showing a sixth preferred embodiment of the present invention.
Figure 18:
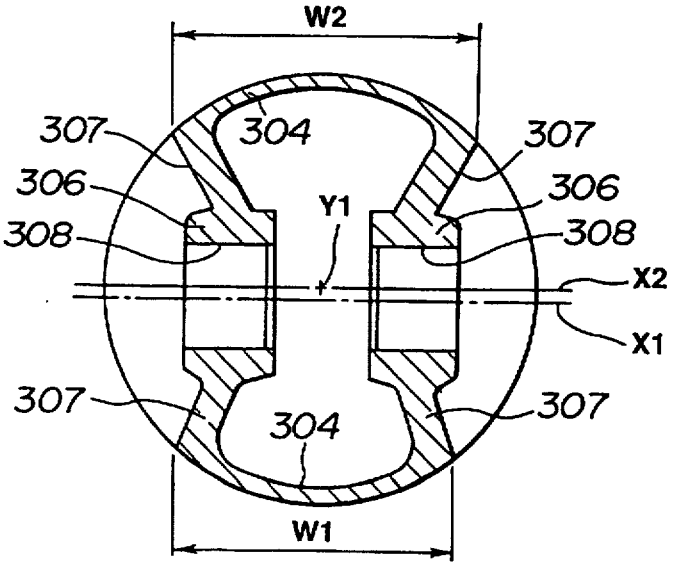
FIG. 18 is a view similar to FIG. 16, taken along the line XVIII—XVIII in FIG. 17.

FIGS. 17–21 show a sixth embodiment of the present invention. Referring to FIGS. 17–18, a piston 301 includes a crown face 302, and a ring land 303 connected to the crown face 302, and a skirt 304 connected to the ring land 303. In the sixth embodiment, the ring land 303 is formed with three piston-ring grooves 305.

Figure 19:
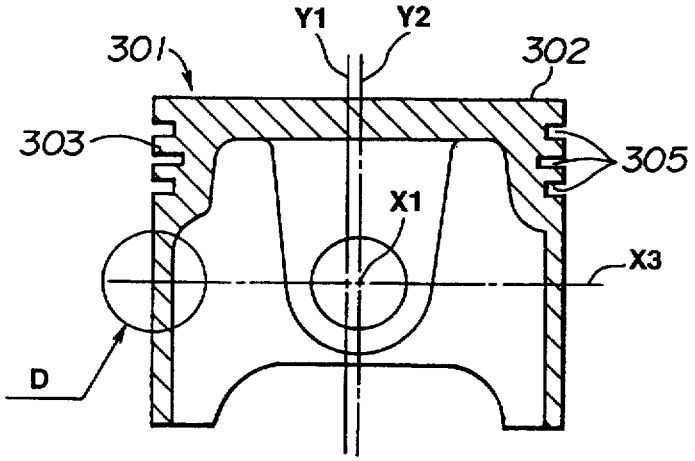
FIG. 19 is a view similar to FIG. 18, taken along the line XIX—XIX in FIG. 17.

Pin bosses 306 are formed at the skirt 304 at the inner periphery, each being connected thereto through an apron 307. The pin bosses 306 are disposed to face each other with respect to an axis Y1 of the piston 301. Each pin boss 306 is formed with a piston-pin hole 308 facing the skirt 304 and having an axis X1 which is substantially perpendicular to the axis Y1 of the piston 301. The axis X1 of the piston-pin hole 308 is offset to the counterthrust side of the piston 301 with respect to the axis Y1 thereof as shown in FIGS. 18–19. Referring to FIG. 19, Y2 is a line which intersects the axis X1 of the piston-pin hole 308 and is parallel to the axis Y1 of the piston 301, and Y3 is a line which intersects the axis X1 of the piston-pin hole 308 and is perpendicular to the axis Y1 of the piston 301.

The oval amount of the skirt 304 of the piston 301 is smaller, at least on the thrust side of the piston 301, in a portion nearer to the ring land 303 than a plane including the axis X1 of the piston-pin hole 308 than in a portion far therefrom. Therefore, referring to FIG. 17, when contacting an inner periphery of a cylinder, not shown, the piston 301 forms a contact surface 309 having a larger circumferential area in the portion nearer to the ring land 303 than the plane including the axis X1 of the piston-pin hole 308 than in the portion far therefrom.

The dimension of the skirt 304 in the direction of the axis X1 of the piston-pin hole 308 is larger in the portion nearer to the ring land 303 than the plane including the axis X1 of the piston-pin hole 308 than in the portion far therefrom. That is, referring to FIGS. 17–18, with the skirt 304, a dimension W2 in the portion nearer to ring land 303 than the plane including the axis X1 of the piston-pin hole 308 is larger than a dimension W1 in the portion far therefrom.

In the sixth embodiment, as shown in FIG. 18, the dimension W2 of the skirt 304 is determined to increase only on the thrust side of the piston 301, and correspond to the dimension W1 on the counterthrust side thereof. This determination, which is made in accordance with results of a behavior analysis of the piston 301 in the cylinder, allows a weight reduction of the piston 301 as compared with a piston with the dimension of the skirt 304 being increased on both thrust and counterthrust sides thereof. Moreover, an increase in the dimension W2 of the skirt 304 facilitates a deformation thereof on the thrust side of the piston 301, contributing to an improvement of the anti-seizure performance of the piston 301 with respect to an inner surface of the cylinder when the engine is operated at high speed and high load to give a greater side force to the piston 301 as will be described later.

Figure 20:
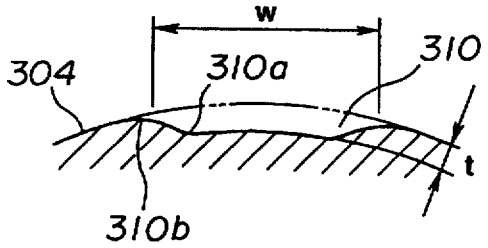
FIG. 20 is an enlarged section, taken along the line XX—XX in FIG. 17.
Figure 21:
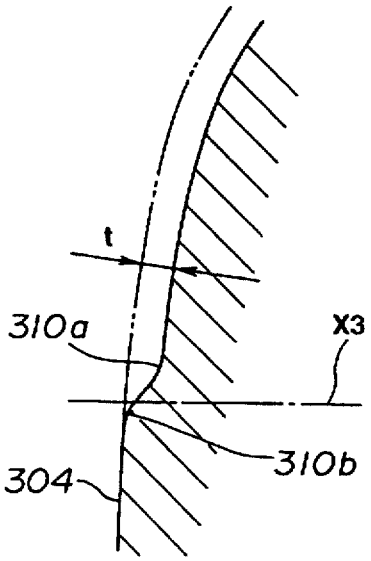
FIG. 21 is a view similar to FIG. 20, showing a portion D in FIG. 19.

As shown in FIG. 17, a recess 310 is formed on the skirt 304 on an outer periphery of the portion nearer to the ring land 303 than the plane including the axis X1 of the piston-pin hole 308. Referring to FIGS. 20–21, the recess 310 is open on the side of the ring land 303, and has a predetermined width w and a predetermined depth t. The recess 310 has a circular portion between a bottom corner 310*a* and a surface corner 310*b* where the recess 310 starts from a barrel of the piston 301.

Excellent results were given when the recess 310 of the skirt 304 on the outer periphery has the width equal to approximately ⅓ the dimension W1 of the skirt 304, and the depth equal to approximately 20 μm.

The piston 301 is arranged in an engine, not shown, for operation. When the engine is operated at middle or low speed and lower load to give a smaller side force to the piston 301, an increase in a contact area of the skirt 304 of the piston 301 with the inner surface of the cylinder is restricted by the recess 310, enabling restrained increase in the friction of the piston 301 with the inner surface of the cylinder. That is, the oval amount of the piston 301 is smaller in the portion nearer to the ring land 303 than the plane including the axis X1 of the piston-pin hole 308 than in the portion far therefrom, and the recess 310 is formed on the skirt 304 on the outer periphery of the portion having smaller oval amount and thus increased contact area with the inner surface of the cylinder, and being nearer to the ring land 303 than the plane including the axis X1 of the piston-pin hole 308, enabling restrained increase in the contact area of the piston 301 with the inner surface of the cylinder, resulting in restrained friction thereof.

On the other hand, when the engine is operated at high speed and high load to give a greater side force to the piston 301, the skirt 304 of the piston 301 is deformed elastically. Thus, the recess 310 of the skirt 304 on the outer periphery also contacts the inner surface of the cylinder. This results in substantial increase in the contact area of piston 301 in spite of existence of the recess 310 of the skirt 304, enabling an improvement of the anti-seizure performance of the piston 301 with respect to the inner surface of the cylinder.

Moreover, the recess 310 of the skirt 304 serves as an introduction passage of lubricating oil or engine oil, contributing to favorable formation of an oil film on a contact surface of the piston 310 with the inner surface of the cylinder.

Therefore, according to the sixth embodiment, the piston 301 can be obtained with no seizure and reduced friction with the inner surface of the cylinder.

Figure 22:
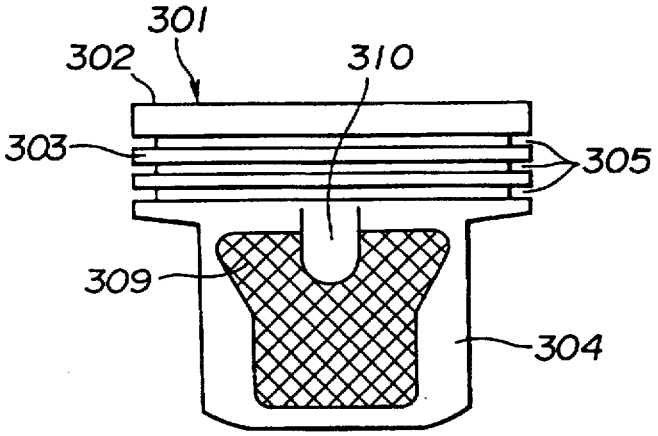
FIG. 22 is a view similar to FIG. 17, showing a seventh preferred embodiment of the present invention.
Figure 23:
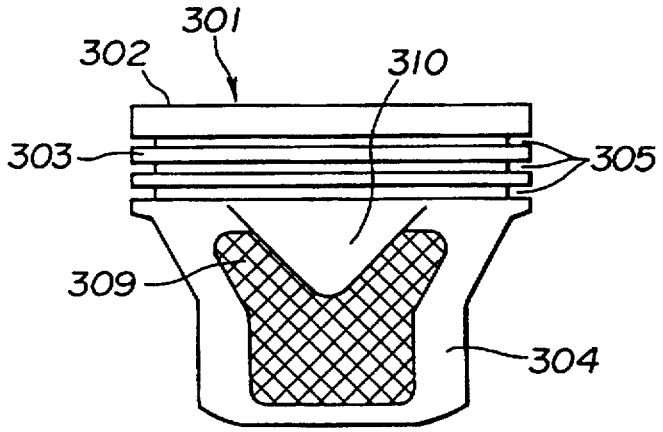
FIG. 23 is a view similar to FIG. 22, showing an eighth preferred embodiment of the present invention.
Figure 24:
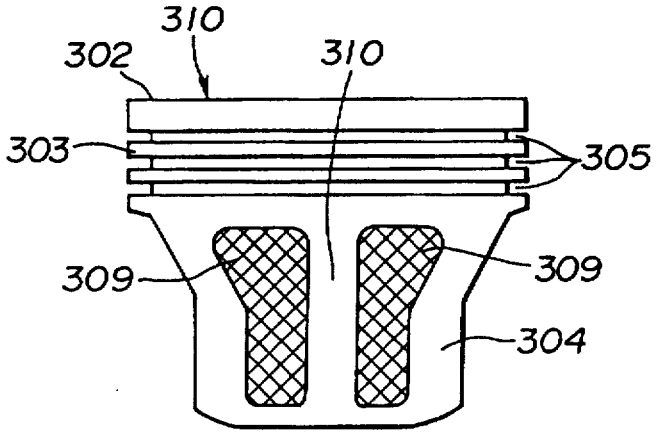
FIG. 24 is a view similar to FIG. 23, showing a ninth preferred embodiment of the present invention.

FIGS. 22–24 show seventh to ninth embodiments of the present invention. These embodiments are substantially the same as the sixth embodiment except the following. In the seventh embodiment as shown in FIG. 22, the dimension of the skirt 304 in the direction of the axis X1 of the piston-pin hole 308 is not larger in the portion nearer to the ring land 303 than the plane including the axis X1 of the piston-pin hole 308 than in the portion far therefrom, and the dimension of the piston 301 is the same on the thrust and counterthrust sides.

In the eighth embodiment as shown in FIG. 23, the recess 310 of the skirt 304 on the outer periphery is shaped to have the width increased to the ring land 303. In the ninth embodiment as shown in FIG. 24, the recess 310 of the skirt 304 on the outer periphery is formed to extend from the portion nearer to the ring land 303 than the plane including the axis X1 of the piston-pin hole 308 to the portion far therefrom.

The seventh to ninth embodiments produces the same effect as that of the sixth embodiment. Moreover, in the ninth embodiment, the contact area of the piston 301 with the inner surface of the cylinder is reduced in the portion far from the ring land 303, resulting in further lowering of the friction of the piston 301.

It is noted that the recess 310 of the skirt 304 on the outer periphery may not be open at the ring land 303.

Figure 25:
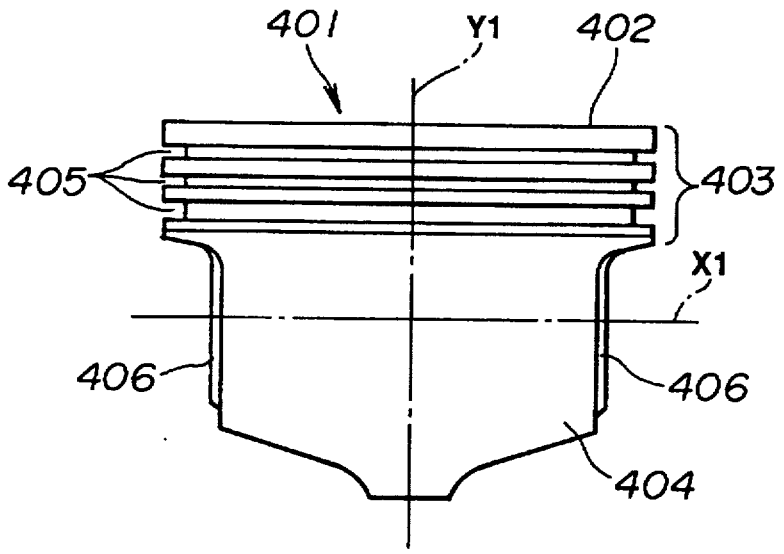
FIG. 25 is a view similar to FIG. 24, showing a tenth preferred embodiment of the present invention.
Figure 26:
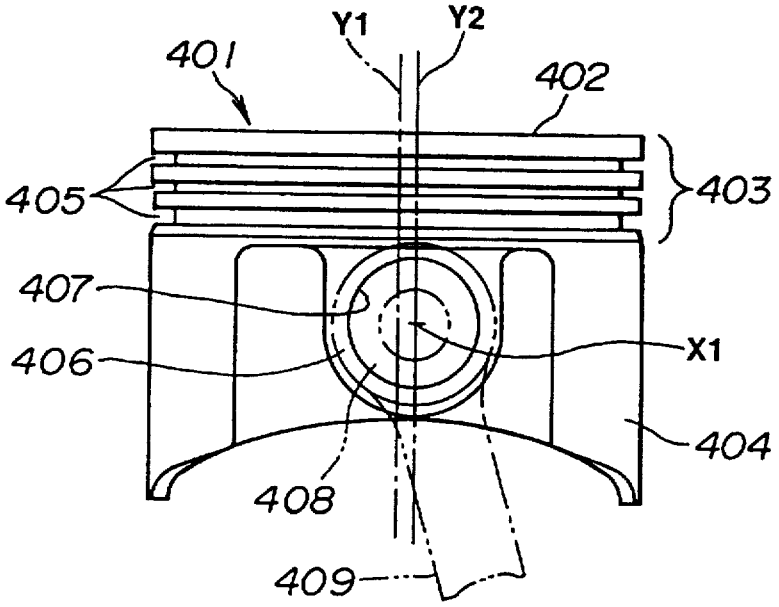
FIG. 26 is a side view showing the tenth embodiment.

FIGS. 25–29 show a tenth embodiment of the present invention. Referring to FIGS. 25–26, a piston 401 includes a crown face 402, and a ring land 403 connected to the crown face 402, and a skirt 404 connected to the ring land 403. In the tenth embodiment, the ring land 403 is formed with three piston-ring grooves 405.

Pin bosses 406 are formed to protrude to the inner periphery of the skirt 404, and are disposed to face each other with respect to an axis Y1 of the piston 401. The pin boss 406 is formed with a piston-pin hole 407 facing the skirt 404 and having an axis X1 which is substantially perpendicular to the axis Y1 of the piston 401. The axis X1 of the piston-pin hole 407 is offset to the counterthrust side of the piston 401 with respect to the axis Y1 thereof as shown in FIG. 26. Referring to FIG. 26, Y2 is a line which intersects the axis X1 of the piston-pin hole 407 and is parallel to the axis Y1 of the piston 401.

A piston pin 408 is arranged through the piston-pin hole 407, and a connecting rod 409 is connected thereto.

Figure 27:
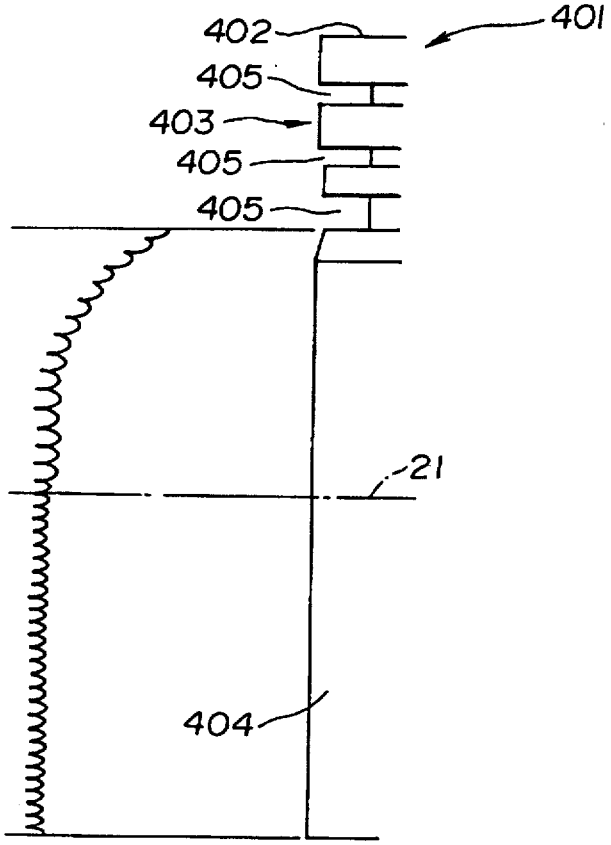
FIG. 27 is a view similar to FIG. 9, showing the surface roughness of a skirt.

The skirt 404 of the piston 401, which was machined, has the surface roughness which is great at least on the thrust side of the piston 401, in a portion nearer to the ring land 403 than a plane including the axis X1 of the piston-pin hole 407, i.e. a portion above the axis X1 as viewed in FIG. 25, and small in a portion far therefrom, i.e. a portion below the axis X1 as viewed in FIG. 25. That is, referring to FIG. 27, in the tenth embodiment, the skirt 404 of the piston 401, which was turned, has linear traces which are rough and deep in the portion above the axis X1 of the piston 401, and fine and shallow in the portion therebelow. Referring to FIG. 27, Z1 is a line which intersects a center of the piston-pin hole 407 and is perpendicular to the axis X1 thereof.

The portion of the skirt 404 with rough and deep linear traces serves to retain lubricating oil or engine oil, having higher retaining performance thereof than the portion of the skirt 404 with fine and shallow linear traces.

In the tenth embodiment, the skirt 404 has greater surface roughness only on the thrust side of the piston 401 to increase the lubricating-oil retaining performance in a portion which undergoes the greatest side force and decrease the slide resistance in the other portions.

Excellent results were given when the surface roughness of the skirt 404 is 15 μm in the portion nearer to the ring land 403 than the plane including the axis X1 of the piston-pin hole 407, and 5 μm in the portion far from the ring land 403.

Figures 28A, 28B, 28C:
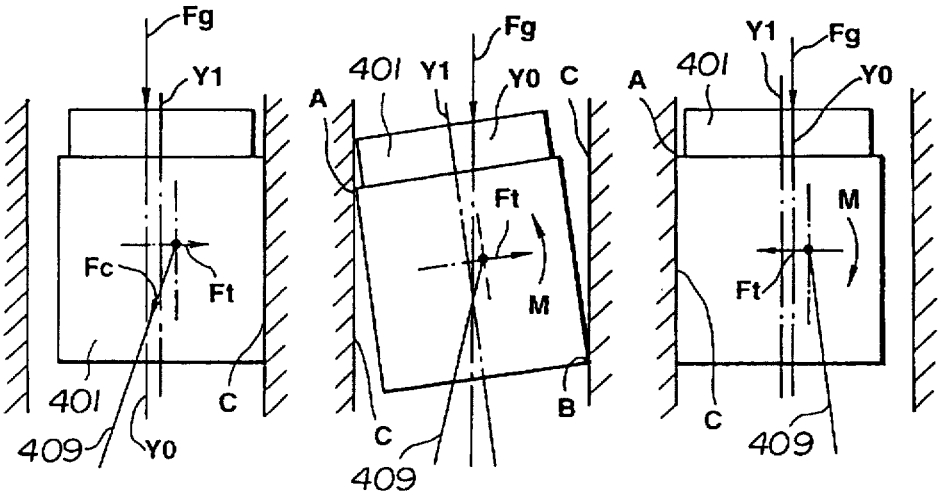
FIG. 28A is a view similar to FIG. 14C, showing a piston before the top dead center of the compression stroke.
FIG. 28B is a view similar to FIG. 28A, showing the piston just before the top dead center of the compression stroke.
FIG. 28C is a view similar to FIG. 28B, showing the piston after the top dead center of the compression stroke.

The piston 401 is arranged in an engine, not shown, for operation. During operation of the engine, the piston 401 shows the behavior as shown in FIGS. 28A–28C in compression and expansion strokes. Referring to FIGS. 28A–28C, Y0 is an axis of a cylinder. Referring to FIG. 28A, before the top dead center of the compression stroke, the piston 401 undergoes a pressure Fg of compressed gas (to be exact, the sum of the pressure of compressed gas and an inertia force of the piston 401). The compressed-gas pressure Fg is split into a force Fc for the connecting rod 409 inclined and a thrust force Ft, so that the piston 401 undergoes the thrust force Ft to move on an inner surface C of the cylinder on the counterthurst side.

When the piston 401 approaches the top dead center, the thrust force Ft is reduced with increasing compressed-gas pressure Fg and decreasing inclination of the connecting rod 409. As a result, referring to FIG. 28B, the piston 401 produces a moment M to rotate counterclockwise on a lower end B of the skirt, having an upper end A of the skirt on the thrust side of the piston 401 contacting the inner surface C of the cylinder on the thrust side thereof. In this state, the piston 401 enters the expansion stroke.

Referring to FIG. 28C, when the piston 401 passes the top dead center, the inclination of the connecting rod 409 is reversed. This changes the direction of the thrust force Ft, so that the piston 401 produces a moment M to rotate clockwise on the upper end A of the skirt, having a side surface of the skirt on the thrust side of the piston 401 contacting the inner surface C of cylinder on the thrust side thereof. After this, the piston 401 enters the expansion stroke to move on the inner surface C of the cylinder on the thrust side of the piston 401.

Figure 29:
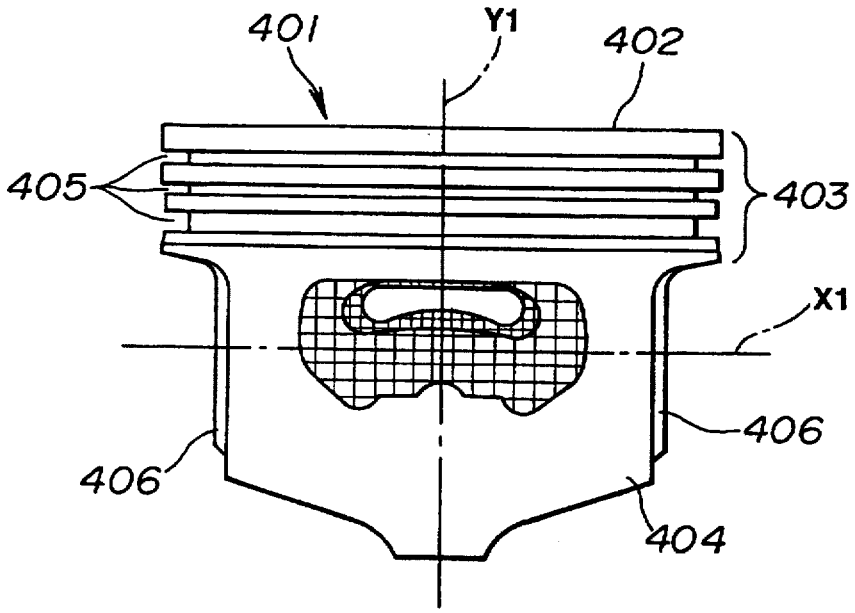
FIG. 29 is a view similar to FIG. 25, showing the distribution of a surface pressure on the piston.

Just after the top dead center, the piston 401 undergoes on the side surface on the thrust side thereof the greatest side force due to the thrust force Ft. Studies revealed that the distribution of a surface pressure on the piston 401 in this case is as shown in FIG. 29. Referring to FIG. 29, a large-grid portion corresponds to an area which undergoes a first surface pressure greater than a predetermined value, and a small-grid portion corresponds to an area which undergoes a second surface pressure slightly greater than the first surface pressure, and a black portion corresponds to an area which undergoes a third surface pressure or the greatest surface pressure. That is, the center of a piston area which undergoes a surface pressure greater than a predetermined value is positioned above the axis X1 of the piston-pin hole 407, and a piston area which undergoes the greatest surface pressure is also positioned thereabove.

According to the tenth embodiment, the surface roughness of the skirt 404 is greater in an upper portion of the skirt 404 which undergoes relatively great side force, i.e. the portion nearer to the ring land 403 than the plane including the axis X1 of the piston-pin hole 407. Thus, the upper portion of the skirt 404 with greater surface roughness has higher lubricating-oil retaining performance. This results in favorable formation of an oil film on a contact surface of the piston 401 at the upper portion of the skirt 404 with the inner surface C of the cylinder, resulting in no seizure of the piston 401 with the inner surface C of the cylinder.

Moreover, the surface roughness of the skirt 404 is smaller in a lower portion of the skirt 404 which undergoes relatively small side force, i.e. the portion farther from the ring land 403 than the plane including the axis X1 of the piston-pin hole 407, resulting in reduced slide resistance of the piston 401 at the lower portion of the skirt 404 with the inner surface C of the cylinder.

Therefore, according to the tenth embodiment, the piston 401 can be obtained with no seizure and reduced friction with the inner surface C of the cylinder.

It is noted that the skirt 404 may be ground in place of being turned.

Figure 30:
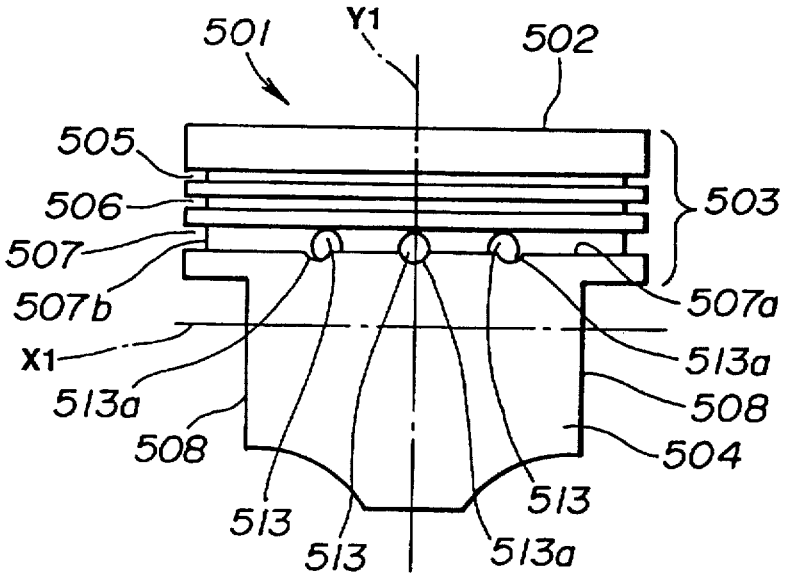
FIG. 30 is a view similar to FIG. 29, showing a eleventh preferred embodiment of the present invention.
Figure 31:
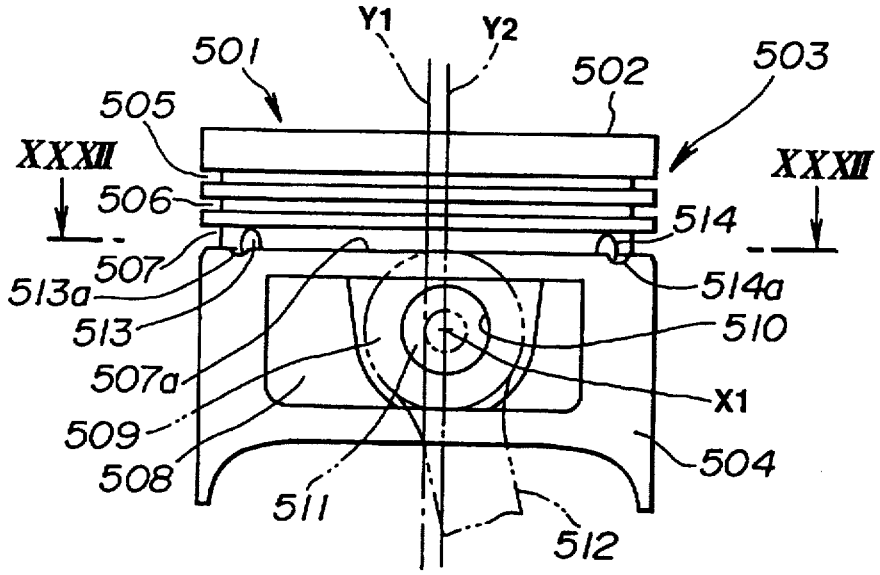
FIG. 31 is a view similar to FIG. 26, showing the eleventh embodiment.

FIGS. 30–34C show an eleventh embodiment of the present invention. Referring to FIGS. 30–31, a piston 501 includes a crown face 502, a ring land 503 connected to the crown face 502, and a skirt 504 connected to the ring land 503. In the eleventh embodiment, the ring land 503 is formed with three piston-ring grooves 505, 506, 507. The piston-ring grooves 505, 506 formed near the crown face 502 serve as compression-ring grooves, and the piston-ring groove 507 formed adjacent to the skirt 504 serves as an oil-ring groove.

Figure 32:
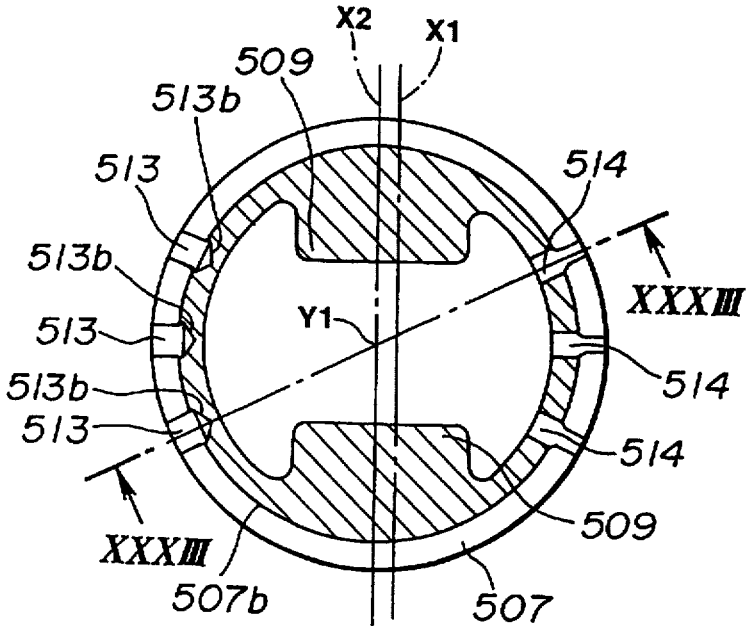
FIG. 32 is a view similar to FIG. 18, taken along the line XXXII—XXXII in FIG. 31.

Aprons 508 are formed at the skirt 504, and pin bosses 509 are formed to protrude to the inner periphery of the skirt 504. As shown in FIG. 32, the aprons 508 and pin bosses 509 are arranged to face each other with respect to an axis Y1 of the piston 501. The pin boss 509 is formed with a piston-pin hole 510 having both ends open at the apron 508. The piston-pin hole 510 has an axis X1 which is substantially perpendicular to the axis Y1 of the piston 501, and is offset to the counterthrust side of the piston 501 with respect to the axis Y1 thereof as shown in FIG. 31.

A piston pin 511 is arranged through the piston-pin hole 510, and a connecting rod 512 is connected thereto.

Figure 33:
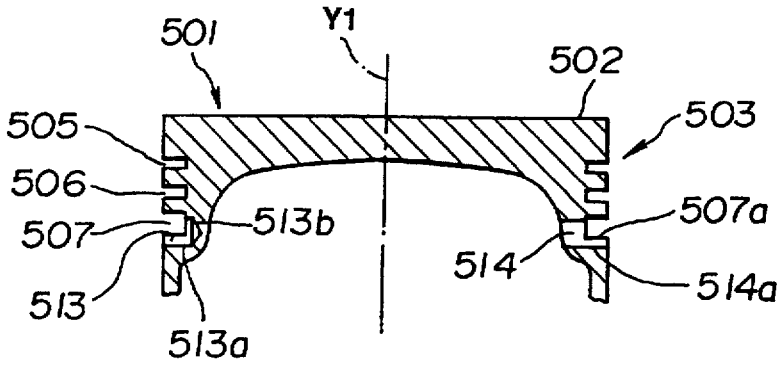
FIG. 33 is a view similar to FIG. 32, taken along the line XXXIII—XXXIII in FIG. 32.

Referring particularly to FIGS. 32–33, three oil holes 513 are formed in the oil-ring groove 507 located above the skirt 504 on the thrust side of the piston 501. Each oil hole 513 has a peripheral edge 513*a* partly extending to the skirt 504 over a side surface 507*a* of the oil-ring groove 507, and a bottom 513*b* which is deeper than a bottom 507*b* of the oil-ring groove 507 and is not in communication with the inner periphery of the piston 501.

Three through holes 514 are formed in the oil-ring groove 507 located in a position substantially symmetrical with the oil holes 513 with respect to the axis Y1 of the piston 501, i.e. above the skirt 504 on the counterthrust side of the piston 501, so as to communicate with the inner periphery of the piston 501. Each through hole 514 has a peripheral edge 514*a* partly extending to the skirt 504 over the side surface 507*a* of the oil-ring groove 507.

Referring to FIG. 31, Y2 is a line which intersects the axis X1 of the piston-pin hole 510 and is parallel to the axis Y1 of the piston 501. Referring to FIG. 32, X2 is a line which intersects the axis Y1 of the piston 501 and is parallel to the axis X1 of the piston-pin hole 510.

Figure 34A:
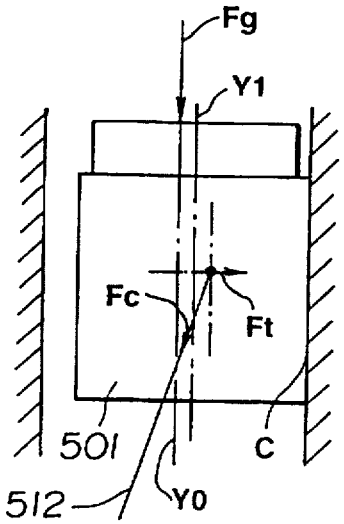
FIG. 34A is a view similar to FIG. 28C, showing a piston before the top dead center of the compression stroke.
Figure 34B:
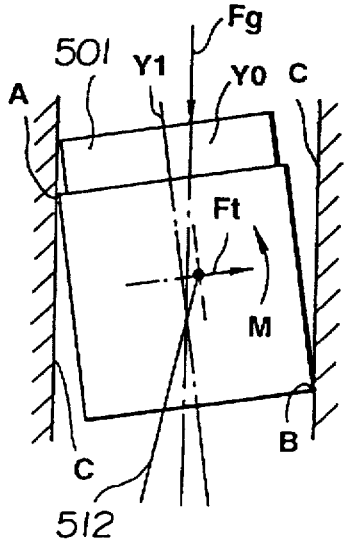
FIG. 34B is a view similar to FIG. 34A, showing the piston just before the top dead center of the compression stroke.
Figure 34C:
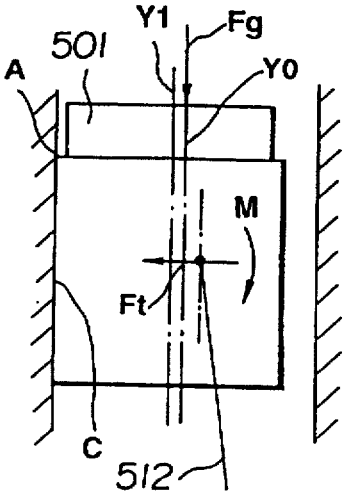
FIG. 34C is a view similar to FIG. 34B, showing the piston after the top dead center of the compression stroke.

The piston 501 is arranged in an engine, not shown, for operation. During operation of the engine, the piston 501 shows the behavior as shown in FIGS. 34A–34C in compression and expansion strokes. Referring to FIG. 34A, before the top dead center of the compression stroke, the piston 501 undergoes a pressure Fg of compressed gas (to be exact, the sum of the pressure of compressed gas and an inertia force of the piston 501). The compressed-gas pressure Fg is split into a force Fc for the connecting rod 512 inclined and a thrust force Ft, so that the piston 501 undergoes the thrust force Ft to move on an inner surface C of the cylinder on the counterthurst side.

When the piston 501 approaches the top dead center, the thrust force Ft is reduced with increasing compressed-gas pressure Fg and decreasing inclination of the connecting rod 512. As a result, referring to FIG. 34B, the piston 501 produces a moment M to rotate counterclockwise on a lower end B of the skirt, having an upper end A of the skirt on the thrust side of the piston 501 contacting the inner surface C of the cylinder on the thrust side thereof. In this state, the piston 501 enters the expansion stroke.

Referring to FIG. 34C, when the piston 501 passes the top dead center, the inclination of the connecting rod 512 is reversed. This changes the direction of the thrust force Ft, so that the piston 501 produces a moment M to rotate clockwise on the upper end A of the skirt, having a side surface of the skirt on the thrust side of the piston 501 contacting the inner surface C of cylinder on the thrust side thereof. After this, the piston 501 enters the expansion stroke to move on the inner surface C of the cylinder on the thrust side of the piston 501.

Just after the top dead center, the piston 501 undergoes on the side surface on the thrust side thereof the greatest side force due to the thrust force Ft, being put in the severe state in view of seizure with the inner surface C of the cylinder.

According to the eleventh embodiment, the oil holes 513, which are formed in the oil-ring groove 507 located above the skirt 504 on the thrust side of the piston 501, serves as a reservoir of lubricating oil or engine oil. This contributes to favorable formation of an oil film on a contact surface of the piston 501 with the inner surface C of the cylinder on the thrust side of the piston 501, resulting in no seizure and reduced friction thereat. Moreover, due to the oil holes 513 formed in the oil-ring groove 507 located above the skirt 504, lubricating oil discharged from the oil holes 513 with reciprocating motion of the piston 501 can effectively be supplied to the skirt 504 without running to the apron 508. Therefore, the piston 501 can be obtained with no seizure and reduced friction with the inner surface C of the cylinder.

Further, due to the peripheral edge 513*a* of the oil hole 513 partly extending to the skirt 504 over the side surface 507*a* of the oil-ring groove 507, lubricating oil supplied to the oil-ring grooves 507 can efficiently be accumulated in the oil hole 513.

Still further, due to the bottom 513*b* of the oil hole 513 formed to be deeper than the bottom 507*b* of the oil-ring groove 507 and not in communication with the inner periphery of the piston 501, the volume of the oil hole 513 is increased, enabling accumulation of more lubricating oil therein.

Furthermore, due to the through holes 514 formed in the oil-ring groove 507 located in the position substantially symmetrical with the oil holes 513 with respect to the axis Y1 of the piston 501, excess lubricating oil is collected in an oil pan, not shown, from the counterthrust side of the piston 501 which does not undergo a great thrust force in the expansion strokes thereof through the through holes 514 and the inner periphery of the piston 501. This can effectively prevent the consumption of lubricating oil from increasing.

Further, due to the peripheral edge 514*a* of the through hole 514 partly extending to the skirt 504 over the side surface 507*a* of the oil-ring groove 507, lubricating oil supplied to the oil-ring groove 507 can efficiently be collected in the oil pan through the through hole 514.

It is noted that the number of the oil hole 513 and the through hole 514 may be one or four or more, and that the sectional shape of the oil hole 513 and the through hole 514 is not limited to a circle, but may be of different shapes.

Figure 35:
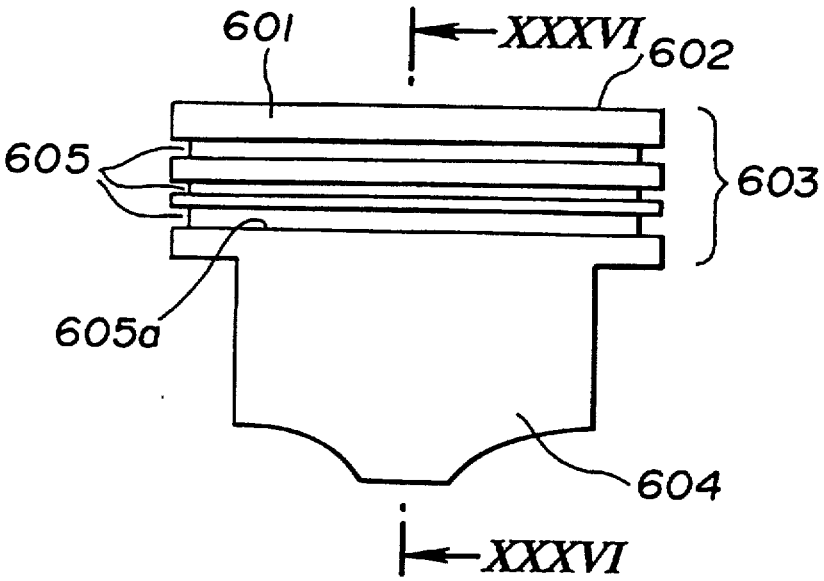
FIG. 35 is a view similar to FIG. 29, showing a twelfth preferred embodiment of the present invention.
Figure 36:
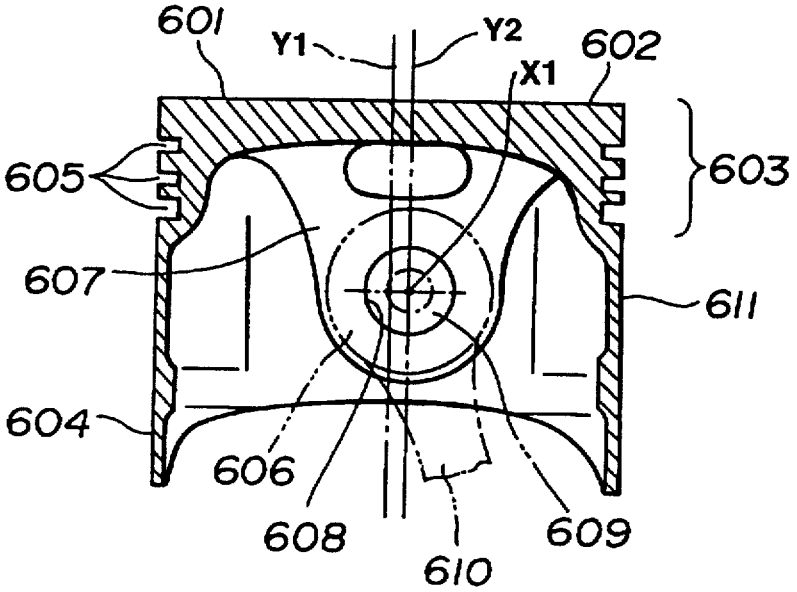
FIG. 36 is a view similar to FIG. 19, taken along the line XXXVI—XXXVI in FIG. 35.
Figure 37:
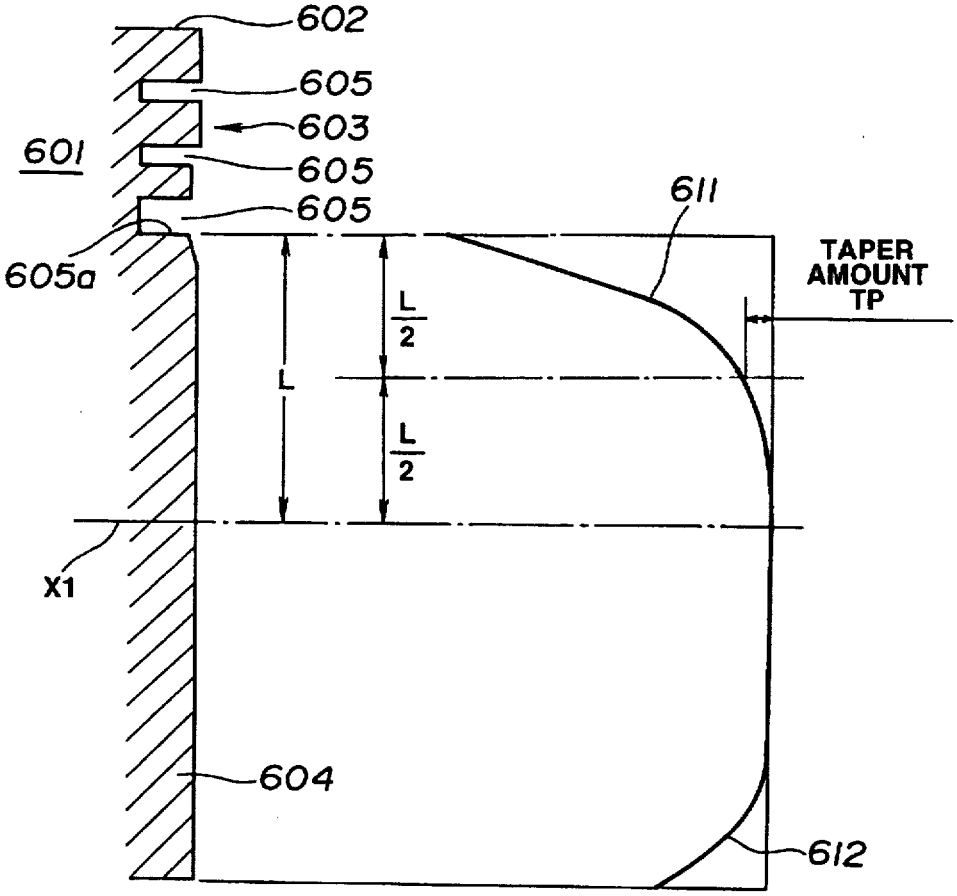
FIG. 37 is a view similar to FIG. 27, showing the shape of a taper formed at a skirt.

FIGS. 35–39 show a twelfth embodiment of the present invention. Referring to FIGS. 35–36, a piston 601 includes a crown face 602, and a ring land 603 connected to the crown face 602, and a skirt 604 connected to the ring land 603. In the twelfth embodiment, the ring land 603 is formed with three piston-ring grooves 605.

Pin bosses 606 are formed at the skirt 604 at the inner periphery, each being connected thereto through an apron 607. The pin bosses 606 are disposed to face each other with respect to an axis Y1 of the piston 601. The pin boss 606 is formed with a piston-pin hole 608 facing the skirt 604 and having an axis X1 which is substantially perpendicular to the axis Y1 of the piston 601. The axis X1 of the piston-pin hole 608 is offset to the counterthrust side of the piston 601 with respect to the axis Y1 thereof as shown in FIG. 36. Referring to FIG. 36, Y2 is a line which intersects the axis X1 of the piston-pin hole 608 and is parallel to the axis Y1 of the piston 601.

A piston pin 609 is arranged through the piston-pin hole 608, and a connecting rod 610 is connected thereto.

A taper 611 is formed at the skirt 604 of the piston 601. Specifically, the taper 111 is formed at the skirt 604 in a portion nearer to the ring land 603 than a plane including the axis X1 of the piston-pin hole 608, i.e. a portion above the axis X1. The taper 611 has a shape to converge on the ring land 603. Specifically, referring to FIG. 37, the taper 611 has a taper amount TP increased to the ring land 603 in a quadratic-curve way.

It is noted that the taper 611 can be formed at least at the skirt 604 on the thrust side of the piston 601 when taking account of the behavior of the piston 601 as will be described later.

Figure 39:
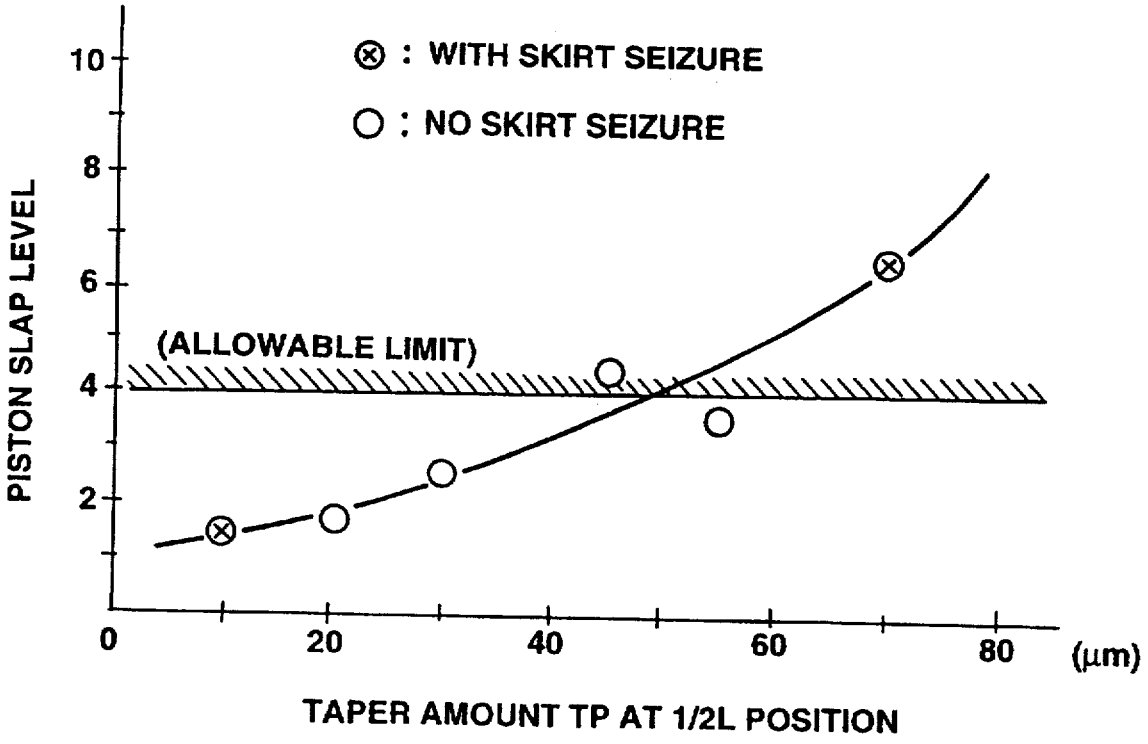
FIG. 39 is a graphical representation showing results of experiments on the piston.

Results as shown in FIG. 39 were given through experiments using pistons 601 having 86 mm diameter and different taper amount TP of the taper 611. The experiments revealed that, at a position of half of a dimension L from the axis X1 of the piston-pin hole 608 to a side surface 605*a* of the piston ring groove 605 disposed the nearest to the skirt 604 (see FIG. 37), the piston 601 with 10 μm taper amount TP has a reduced piston-slap level but shows a sign of seizure at the skirt 604, and the piston 601 with 70 μm taper amount TP has a piston-slap level exceeding its allowable limit and shows a sign of seizure at the skirt 604. Moreover, with 20–55 μm taper amount TP, the piston 601 with 45 μm taper amount has a slightly increased piston-slap level, but shows no seizure.

It will be thus understood that the experiments revealed that the taper amount TP is preferably in a range of 15–50 μm, i.e. a value obtained by multiplying the diameter (μm) of the piston 601 by 0.00015 to 0.0006 at a position of half of a dimension L from the axis X1 of the piston-pin hole 608 to a side surface 605*a* of the piston ring groove 605 disposed the nearest to the skirt 604.

In the twelfth embodiment, a taper 612 is formed at an end of the skirt 604 far from the ring land 603, i.e. a lower end thereof, to converge on this end.

Figures 38A, 38B, 38C:
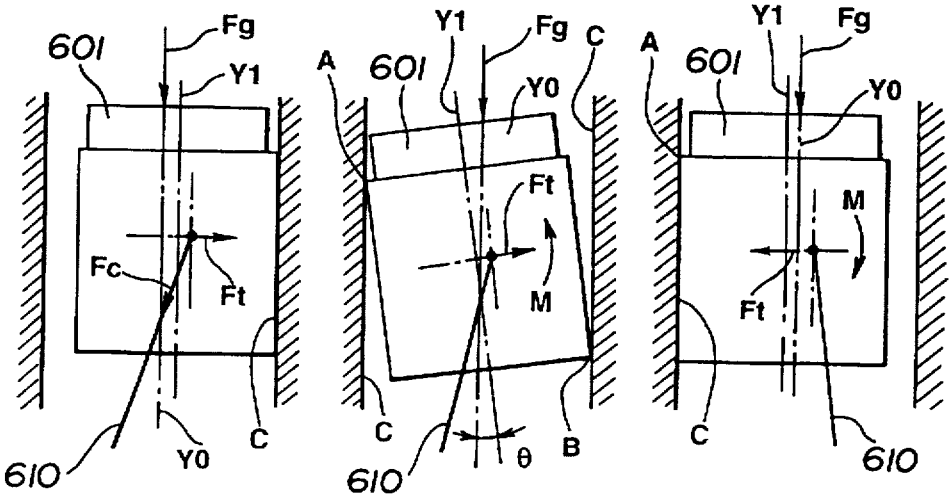
FIG. 38A is a view similar to FIG. 34C, showing a piston before the top dead center of the compression stroke.
FIG. 38B is a view similar to FIG. 38A, showing the piston just before the top dead center of the compression stroke.
FIG. 38C is a view similar to FIG. 38B, showing the piston after the top dead center of the compression stroke.

The piston 601 is arranged in an engine, not shown, for operation. During operation of the engine, the piston 601 shows the behavior as shown in FIGS. 38A–38C in compression and expansion strokes. Specifically, referring to FIG. 38A, before the top dead center of the compression stroke, the piston 601 undergoes a pressure Fg of compressed gas (to be exact, the sum of the pressure of compressed gas and an inertia force of the piston 601). The compressed-gas pressure Fg is split into a force Fc for the connecting rod 610 inclined and a thrust force Ft, so that the piston 601 undergoes the thrust force Ft to move on an inner surface C of a cylinder on the counterthurst side.

When the piston 601 approaches the top dead center, the thrust force Ft is reduced with increasing compressed-gas pressure Fg and decreasing inclination of the connecting rod 610. As a result, referring to FIG. 38B, the piston 601 produces a moment M to rotate counterclockwise on a lower end B of the skirt, having an upper end A of the skirt on the thrust side of the piston 601 contacting the inner surface C of the cylinder on the thrust side thereof. In this state, the piston 601 enters the expansion stroke.

Referring to FIG. 38C, when the piston 601 passes the top dead center, the inclination of the connecting rod 610 is reversed. This changes the direction of the thrust force Ft, so that the piston 601 produces a moment M to rotate clockwise on the upper end A of the skirt, having a side surface of the skirt on the thrust side of the piston 601 contacting the inner surface C of cylinder on the thrust side thereof. After this, the piston 601 enters the expansion stroke to move on the inner surface C of the cylinder on the thrust side of the piston 601.

In the vicinity of the top dead center of the compression stroke, the upper end A of the skirt is inclined by contacting the inner surface C of the cylinder. According to the third embodiment, since the taper 611 is formed at the skirt 604 in the portion nearer the ring land 603 than the plane including the axis X1 of the piston-pin hole 608, an inclination θ of the axis Y1 of the piston 601 with respect to an axis Y0 of the cylinder is smaller than that of the conventional piston.

Therefore, in the expansion stroke just after explosion, when rotating clockwise on the upper end A of the skirt to have the side surface contacting the inner surface C of the cylinder, the piston 601 ensures rotation with reduced angle. This results in less kinetic energy of the piston 601, and thus less occurrence of hammering. Therefore, the piston 601 can be obtained with piston slap maximally reduced.

Having described the present invention in connection with the preferred embodiments, it is noted that the present invention is not limited thereto, and various changes and modifications can be made without departing from the spirit of the present invention.

What is claimed is:

1. A piston for an internal combustion engine, comprising:

a ring land formed with a piston-ring groove;

a skirt connected to said ring land so that said piston-ring groove is adjacent to said skirt, said skirt being formed with a piston-pin hole with a first axis substantially perpendicular to a central longitudinal axis of said piston; and a taper formed on an external surface of said skirt, said taper extending from a side surface of said piston-ring groove toward a plane including said first axis of said piston-pin hole, said taper converging on said ring land, said taper extending to at least a reference point located at half a distance between said first axis of said piston-pin hole and said side surface of said piston-ring groove.

2. A piston as claimed in claim 1, wherein said piston-pin hole has a second axis substantially perpendicular to said first axis, and wherein said second axis of said piston-pin hole is offset toward a counterthrust side of said piston with respect to said central longitudinal axis of said piston.

3. A piston as claimed in claim 1, wherein said taper is arranged on a thrust side of the piston.

4. A piston as claimed in claim 3, wherein said piston has an imaginary axis parallel to said central longitudinal axis and intersecting said reference point, and said taper has a taper amount defined as a distance along said first axis from said imaginary axis to an outermost point of said skirt on said thrust side, said taper amount having a value given by multiplying a diameter (μm) of said piston by 0.00015 to 0.0006.

5. A piston as claimed in claim 1, wherein said skirt is, on a thrust side of the piston, gradually circumferentially increased in thickness from positions along a plane that is substantially perpendicular to said first axis of said piston-pin hole and that divides the thrust side of the piston and a counterthrust side of the piston.

6. A piston as claimed in claim 1, wherein said piston-ring groove is formed, on a thrust side of the piston, with a slit for fluid communication between inside and outside of the piston.

7. A piston as claimed in claim 6, wherein said slit is formed with a recess hole at either circumferential end thereof.

8. A piston as claimed in claim 1, wherein said skirt has a surface roughness which, at least on a thrust side of the piston, is greater in a first portion nearer said ring land relative to said plane than in a second portion farther from said ring land relative to said plane.

9. A piston as claimed in claim 1, wherein said piston-ring groove is formed with a hole on the thrust side of the piston, said hole partly extending to said skirt over said side surface of said piston-ring groove, said hole being deeper than said piston-ring groove, said hole failing to be in communication with an inner periphery of the piston.

10. A piston as claimed in claim 9, wherein said ring land is formed with a through hole located to be substantially symmetrical with said hole of said piston-ring groove with respect to said central longitudinal axis of the piston, said through hole partly extending to said skirt over said side surface of said piston-ring groove, said through hole communicating with said inner periphery of the piston.

* * * * *